US008802616B2

(12) United States Patent
Manna et al.

(10) Patent No.: US 8,802,616 B2
(45) Date of Patent: Aug. 12, 2014

(54) POLYMERS FOR LAUNDRY DETERGENTS

(75) Inventors: Joseph Manna, Quakertown, PA (US); Roy Roberts, Bristol, PA (US); Jan Edward Shulman, Newtown, PA (US)

(73) Assignee: Rohm and Haas Company, Philadelphia, PA (US)

( * ) Notice: Subject to any disclaimer, the term of this patent is extended or adjusted under 35 U.S.C. 154(b) by 0 days.

(21) Appl. No.: 13/178,592

(22) Filed: Jul. 8, 2011

(65) Prior Publication Data

US 2012/0015861 A1 Jan. 19, 2012

Related U.S. Application Data

(60) Provisional application No. 61/365,439, filed on Jul. 19, 2010.

(51) Int. Cl.
*C11D 1/00* (2006.01)
*C11D 3/37* (2006.01)

(52) U.S. Cl.
USPC ..... 510/476; 510/276; 510/475; 510/477; 510/535

(58) Field of Classification Search
CPC ..... C11D 1/00; C11D 3/37; C11D 3/3715; C11D 3/3765
USPC ..... 510/276, 475, 476, 477, 535
See application file for complete search history.

(56) References Cited

U.S. PATENT DOCUMENTS

| | | | | |
|---|---|---|---|---|
| 5,507,971 | A * | 4/1996 | Ouzounis et al. | 510/434 |
| 6,911,054 | B2 * | 6/2005 | Boeckh et al. | 8/181 |
| 2011/0230387 | A1 * | 9/2011 | Leyrer et al. | 510/434 |

FOREIGN PATENT DOCUMENTS

| | | | | |
|---|---|---|---|---|
| WO | WO 02/10329 | * | 2/2002 | C11D 17/00 |
| WO | WO 2009/019225 | * | 2/2009 | C08F 220/06 |

* cited by examiner

*Primary Examiner* — Brian P Mruk
(74) *Attorney, Agent, or Firm* — Kenneth Crimaldi

(57) ABSTRACT

A detergent composition having at least two components. The first component is from 8 to 50 wt % surfactants. The second component is from 0.05 to 4 wt % of a polymer which has polymerized residues of 40 to 80 wt % $C_1$-$C_4$ alkyl acrylates, 20 to 52 wt % $C_3$-$C_6$ carboxylic acid monomers, and 0 to 10 wt % of monomers having an alkyl group having at least ten carbon atoms.

12 Claims, No Drawings

POLYMERS FOR LAUNDRY DETERGENTS

This application claims the benefit of priority under 35 U.S.C. §119(e) of U.S. Provisional Applications No. 61/365,439 filed Jul. 19, 2010.

BACKGROUND

This invention generally relates to an improved detergent composition comprising acrylic polymers.

Polymers made from acrylic acid are known as additives for laundry detergents. For example, U.S. Pat. No. 5,409,629 discloses a polymer comprising polymerized residues of acrylic acid and ethyl acrylate. However, the prior art does not disclose a polymer according to the present invention which gives superior results as a laundry detergent additive.

The problem solved by the present invention is to provide an improved detergent composition comprising acrylic polymers.

STATEMENT OF THE INVENTION

The present invention is directed to a detergent composition comprising: (a) from 8 to 50 wt % surfactants; and (b) from 0.05 to 4 wt % of at least one polymer comprising polymerized residues of: (i) 40 to 80 wt % $C_1$-$C_4$ alkyl acrylates; wherein at least 4/10 of the $C_1$-$C_4$ alkyl acrylates is ethyl acrylate; (ii) 20 to 52 wt % $C_3$-$C_6$ carboxylic acid monomers; and (iii) 0 to 10 wt % of monomers having an alkyl group having at least ten carbon atoms.

DETAILED DESCRIPTION OF THE INVENTION

All percentages are weight percentages (wt %) and all fractions are by weight, unless otherwise indicated and all temperatures are in ° C., unless otherwise indicated. Measurements made at "room temperature" (room temp.) were made at 20-25° C. Weight average molecular weights, $M_w$, are measured on hydrolyzed polymers by gel permeation chromatography (GPC) using polyacrylic acid standards, as is known in the art. The techniques of GPC are discussed in detail in Modern Size Exclusion Chromatography, W. W. Yau, J. J. Kirkland, D. D. Bly; Wiley-Interscience, 1979, and in A Guide to Materials Characterization and Chemical Analysis, J. P. Sibilia; VCH, 1988, p. 81-84. The molecular weights reported herein are in units of daltons. As used herein the term "(meth)acrylic" refers to acrylic or methacrylic. A "$C_3$-$C_6$ carboxylic acid monomer" is a mono-ethylenically unsaturated compound having one or two carboxylic acid groups, e.g., (meth)acrylic acid, maleic acid, fumaric acid, itaconic acid, maleic anhydride, crotonic acid, etc. Alkyl groups are saturated hydrocarbyl groups which may be straight or branched. Aralkyl groups are alkyl groups substituted by aryl groups. Examples of aralkyl groups include, e.g., benzyl, 2-phenylethyl and 1-phenylethyl. Aralkylphenyl groups are phenyl groups having one or more aralkyl substituents, e.g., 2,4,6-tris(1-phenylethyl)phenyl.

Preferably, the polymer is an acrylic polymer, i.e., one having at least 50 wt % polymerized residues of acrylic monomers, preferably at least 70 wt %, preferably at least 80 wt %, preferably at least 90 wt %, preferably at least 95 wt %, preferably at least 98 wt %. Acrylic monomers include (meth) acrylic acids and their $C_1$-$C_{22}$ alkyl or hydroxyalkyl esters, including monomers of structure $H_2C{=}C(R)CO_2(CH_2CH_2O)_n(CH(R')CH_2O)_mR''$; crotonic acid, itaconic acid, fumaric acid, maleic acid, maleic anhydride, (meth) acrylamides, (meth)acrylonitrile and alkyl or hydroxyalkyl esters of crotonic acid, itaconic acid, fumaric acid or maleic acid. The acrylic polymer may also comprise other polymerized monomer residues including, e.g., non-ionic (meth) acrylate esters, cationic monomers, $H_2C{=}C(R)C_6H_4C(CH_3)_2NHCO_2(CH_2CH_2O)_n(CH(R')CH_2O)_mR''$, $H_2C{=}C(R)C(O)X(CH_2CH_2O)_n(CH(R')CH_2O)_mR''$, monounsaturated dicarboxylates, vinyl esters, vinyl amides (including, e.g., N-vinylpyrrolidone), sulfonated acrylic monomers, vinyl sulfonic acid, vinyl halides, phosphorus-containing monomers, heterocyclic monomers, styrene and substituted styrenes. Preferably, the polymer contains no more than 5 wt % sulfur- or phosphorus-containing monomers, preferably no more than 3 wt %, preferably no more than 2 wt %, preferably no more than 1 wt %. Preferably, the polymer has a weight average molecular weight ($M_w$) in the range from 10,000 to 220,000, preferably from 10,000 to 190,000, preferably from 15,000 to 170,000, preferably from 20,000 to 100,000, preferably from 20,000 to 60,000.

Preferably, the detergent composition comprises 35 to 85 wt % water. Preferably, the detergent composition comprises at least 40 wt % water, preferably at least 45 wt %, preferably at least 50 wt %, preferably at least 60 wt %. Preferably, the detergent composition comprises no more than 70 wt % water, preferably no more than 60 wt %, preferably no more than 50 wt %, preferably no more than 45 wt %, preferably no more than 40 wt %. Preferably, the detergent composition is a liquid or gel at 20° C.

Preferably, the surfactant comprises at least one surfactant selected from anionic and nonionic surfactants. Preferably, nonionic surfactants have an alkyl group having at least ten carbon atoms and at least five polymerized ethylene oxide or propylene oxide residues. Preferably, anionic surfactants have an alkyl group having at least ten carbon atoms and an anionic group, preferably selected from sulfonates and carboxylates. Anionic surfactants also may have polymerized residues of ethylene oxide, and/or may have aromatic rings, e.g., linear alkylbenzene sulfonates. Some anionic surfactants are fatty acid alkali metal salts. Preferably, the detergent composition comprises at least 20 wt % surfactants, preferably at least 25 wt %, preferably at least 30 wt %, preferably at least 35 wt %, preferably at least 40 wt %. Preferably, the detergent composition comprises no more than 46 wt % surfactants, preferably no more than 42 wt %, preferably no more than 38 wt %, preferably no more than 34 wt %. Preferably, the detergent composition comprises at least 6 wt % linear alkylbenzene sulfonates, preferably at least 8 wt %, preferably at least 10 wt %, preferably at least 12 wt %, preferably at least 14 wt %. Preferably, the detergent composition comprises no more than 20 wt % linear alkylbenzene sulfonates, preferably no more than 18 wt %, preferably no more than 16 wt %.

The detergent composition contains from 0.05 to 4 wt % of at least one polymer, calculated on a polymer solids basis relative to the entire weight of the detergent. Preferably, the detergent composition contains at least 0.2 wt % of the polymer(s), preferably at least 0.3 wt %, preferably at least 0.4 wt %, preferably at least 0.5 wt %, preferably at least 0.6 wt %, preferably at least 0.8 wt %. Preferably, the detergent composition contains no more than 3.5 wt % of the polymer(s), preferably no more than 3 wt %, preferably no more than 2.5 wt %, preferably no more than 2 wt %, preferably no more than 1.5 wt %. If more than one polymer is present, the total amount of such polymers is within the above limits. The detergent composition may also contain 5 to 30 wt %, preferably 8 to 20 wt % of other ingredients, e.g., solvents (e.g., propylene glycol, ethanol; typically 4 to 8 wt %), fragrances, enzymes, rheology modifiers, salts (e.g., sodium citrate), sodium/potassium (bi)carbonate and/or (di)silicate and other chelants, e.g., methylglycine N,N-diacetic acid (MGDA), glutamic acid N,N-diacetic acid (GLDA), 2-hydroxyethyliminodiacetic acid (HEIDA) or their salts, e.g., the sodium salts.

Preferably, the polymer comprises at least 42 wt % polymerized residues of $C_1$-$C_4$ alkyl acrylates, preferably at least 44 wt %, preferably at least 46 wt %, preferably at least 48 wt %, preferably at least 50 wt %, preferably at least 52 wt %, preferably at least 55 wt %, preferably at least 60 wt %. Preferably the polymer comprises no more than 78 wt % polymerized residues of $C_1$-$C_4$ alkyl acrylates, preferably no more than 76 wt %, preferably no more than 74 wt %, preferably no more than 72 wt %, preferably no more than 70 wt %, preferably no more than 68 wt %. Preferably, the $C_1$-$C_4$ alkyl acrylate residues are $C_2$-$C_3$ alkyl acrylate residues, preferably ethyl acrylate (EA). Preferably, at least 5/10 by weight of the $C_1$-$C_4$ alkyl acrylates is ethyl acrylate, preferably at least 6/10, preferably at least 7/10, preferably at least 8/10, preferably at least 9/10; preferably, the remainder of the $C_1$-$C_4$ alkyl acrylates is n-butyl acrylate (BA) and/or methyl acrylate (MA). Preferably, the polymer contains no more than 15 wt % polymerized residues of (meth)acrylate esters that are not $C_1$-$C_4$ alkyl acrylates, preferably no more than 10 wt %, preferably no more than 7 wt %, preferably no more than 4 wt %.

Preferably, the polymer comprises at least 22 wt % polymerized residues of $C_3$-$C_6$ carboxylic acid monomers, preferably at least 24 wt %, preferably at least 26 wt %, preferably at least 28 wt %, preferably at least 30 wt %, preferably at least 32 wt %. Preferably, the polymer comprises no more than 50 wt % polymerized residues of $C_3$-$C_6$ carboxylic acid monomers, preferably no more than 48 wt %, preferably no more than 45 wt %, preferably no more than 40 wt %. Preferably, the $C_3$-$C_6$ carboxylic acid monomer is a $C_3$-$C_4$ carboxylic acid monomer; preferably (meth)acrylic acid, preferably methacrylic acid (MAA). Preferably, the polymer comprises no more than 30 wt % of polymerized residues of acrylic acid (AA), preferably no more than 28 wt %, preferably no more than 26 wt %.

Preferably, when the polymer comprises at least 50 wt % polymerized residues of $C_1$-$C_4$ alkyl acrylates, the polymer also comprises at least 8 wt % polymerized residues of AA, preferably at least 10 wt % polymerized residues of AA, preferably at least 12 wt % polymerized residues of AA, preferably at least 15 wt % polymerized residues of AA. Preferably, when the polymer comprises at least 55 wt % polymerized residues of $C_1$-$C_4$ alkyl acrylates, the polymer also comprises at least 10 wt % polymerized residues of AA, preferably at least 12 wt % polymerized residues of AA, preferably at least 15 wt % polymerized residues of AA, preferably at least 20 wt % polymerized residues of AA. Preferably, when the polymer comprises at least 50 wt % polymerized residues of $C_1$-$C_4$ alkyl acrylates, at least 7/10 (preferably at least 8/10) of which is EA, the polymer also comprises at least 8 wt % polymerized residues of AA, preferably at least 10 wt % polymerized residues of AA, preferably at least 12 wt % polymerized residues of AA, preferably at least 15 wt % polymerized residues of AA.

Preferably, when the polymer contains from 40 to 60 wt % polymerized residues of $C_1$-$C_4$ alkyl acrylates (preferably from 42 to 55 wt %), the polymer also comprises no more than 28 wt % polymerized residues of AA, preferably no more than 25 wt % polymerized residues of AA, preferably no more than 22 wt % polymerized residues of AA, preferably no more than 19 wt % polymerized residues of AA, preferably no more than 15 wt % polymerized residues of AA.

Preferably, the polymer contains no more than 8 wt % of polymerized residues of monomers having an alkyl group having at least ten carbon atoms, preferably no more than 6 wt %, preferably no more than 3 wt %, preferably no more than 1 wt %. Preferably, the polymer contain no more than 7 wt %, preferably no more than 5 wt %, preferably no more than 3 wt %, preferably no more than 1 wt % of polymerized residues of monomers having an alkyl group having at least eight carbon atoms, preferably an alkyl group having at least six carbon atoms, preferably an alkyl group having at least four carbon atoms. Examples of such monomers are alkyl(meth)acrylates and monomers of structure $H_2C{=}C(R)C(O)X(CH_2CH_2O)_n(CH(R')CH_2O)_mR''$ or $H_2C{=}C(R)C_6H_4C(CH_3)_2NHCO_2(CH_2CH_2O)_n(CH(R')CH_2O)_mR''$; wherein X is O or NH, R is H or $CH_3$, R' is $C_1$-$C_2$ alkyl; R" is $C_8$-$C_{22}$ alkyl, $C_8$-$C_{16}$ alkylphenyl or $C_{13}$-$C_{36}$ aralkylphenyl; n is an average number from 6-100 and m is an average number from 0-50, provided that n≥m and m+n is 6-100. Preferred $C_{10}$-$C_{22}$ alkyl(meth) acrylates are the $C_{10}$-$C_{18}$ alkyl(meth)acrylates, preferably $C_{12}$-$C_{18}$ alkyl(meth)acrylates. Typically, in monomers having structure $H_2C{=}C(R)C(O)X(CH_2CH_2O)_n(CH(R')CH_2O)_mR''$, X is O; R" is $C_8$-$C_{22}$ alkyl, also $C_{10}$-$C_{22}$ alkyl, also $C_{12}$-$C_{20}$ alkyl; n is 15-30 and m is 0-5; also n is 18-25 and m is 0-3; also n is 18-25 and m is 0-2; and R' and R are methyl. Preferably, the polymer contains no more than 10 wt % of polymerized residues of monomers that are not acrylic monomers, preferably no more than 7 wt %, preferably no more than 5 wt %, preferably no more than 2 wt %.

The polymer may be a crosslinked polymer, that is, a crosslinker, such as a monomer having two or more non-conjugated ethylenically unsaturated groups, is included with the copolymer components during polymerization. Preferred examples of such monomers include, e.g., di- or tri-allyl ethers and di- or tri-(meth)acrylyl esters of diols or polyols (e.g., trimethylolpropane diallyl ether, ethylene glycol dimethacrylate), di- or tri-allyl esters of di- or tri-acids, allyl (meth)acrylate, divinyl sulfone, triallyl phosphate, divinylaromatics (e.g., divinylbenzene). Preferably, the amount of polymerized crosslinker residue in the polymer is no more than 0.3 wt %, preferably no more than 0.2 wt %, preferably no more than 0.1 wt %, preferably no more than 0.05 wt %, preferably no more than 0.02 wt %, preferably no more than 0.01 wt %.

Preferably, the polymer is provided as an aqueous composition containing the polymer as discrete particles dispersed in an aqueous medium. In this aqueous dispersion, the average particle diameter of the polymer particles is typically in the range of from 20 to 1,000 nm, preferably in the range of from 50 to 500 nm, and more preferably, in the range of from 75 to 350 nm Particle sizes herein are those determined using a Brookhaven Model BI-90 particle sizer manufactured by Brookhaven Instruments Corporation, Holtsville, N.Y., reported as "effective diameter". The level of polymer particles in the aqueous dispersion is typically in the range of from 15 to 60 wt %, preferably 20 to 50 wt %, based on the weight of the aqueous dispersion.

Preferably, the pH of a liquid laundry detergent composition is adjusted to be in the range of 7 to 11, preferably from 8 to 10, preferably from 8 to 9.5. Suitable bases to adjust the pH of the formulation include mineral bases such as sodium hydroxide and potassium hydroxide; ammonium hydroxide; and organic bases such as mono-, di- or tri-ethanolamine Mixtures of bases may be used. Suitable acids to adjust the pH of the aqueous medium include mineral acid such as hydrochloric acid, phosphorus acid, and sulfuric acid; and organic acids such as acetic acid. Mixtures of acids may be used.

Suitable polymerization techniques for use in the method of this invention include emulsion polymerization and solution polymerization, preferably emulsion polymerization. Aqueous emulsion polymerization processes typically are conducted in an aqueous reaction mixture, which contains at least one monomer and various synthesis adjuvants such as the free radical sources, buffers, and reductants in an aqueous reaction medium. Preferably, a chain transfer agent is used to limit molecular weight, preferably a mercaptan, preferably a $C_8$-$C_{12}$ alkyl mercaptan. The aqueous reaction medium is the continuous fluid phase of the aqueous reaction mixture and contains greater than 50 weight % water and optionally one or more water miscible solvents, based on the weight of the aqueous reaction medium. Suitable water miscible solvents include methanol, ethanol, propanol, acetone, ethylene glycol ethyl ethers, propylene glycol propyl ethers, and diacetone alcohol. Preferably, the aqueous reaction medium contains greater than 90 weight % water, and more preferably, greater than 95 weight % water, based on the weight of the aqueous reaction medium. Most preferred is an aqueous reaction medium containing from 98 to 100 weight % water, based on the weight of the aqueous reaction medium.

Examples

| poly. # | % EA | % BA | % MA-23 | % MAA | % AA | % LMA | % MA | % n-DDM | % solids | Mw |
|---|---|---|---|---|---|---|---|---|---|---|
| A | 45 | 0 | 10 | 45 | 0 | 0 | 0 | 1 | 30.63 | 65,873 |
| B | 28.3 | 28.3 | 0 | 43.3 | 0 | 0 | 0 | 2 | 30.29 | 35,152 |
| C | 52.2 | 0 | 0 | 47.8 | 0 | 0 | 0 | 2 | 30.52 | 33,360 |
| D | 65 | 0 | 0 | 35 | 0 | 0 | 0 | 2 | 30.24 | 31,771 |
| E | 28.3 | 28.3 | 0 | 43.3 | 0 | 0 | 0 | 1.25 | 29.70 | 54,472 |
| F | 52.2 | 0 | 0 | 47.8 | 0 | 0 | 0 | 1.5 | 30.85 | 51,080 |
| G | 65 | 0 | 0 | 35 | 0 | 0 | 0 | 1.3 | 30.62 | 56,101 |
| H | 40 | 0 | 0 | 50 | 0 | 10 | 0 | 2 | 31.06 | 103,790 |
| I | 50 | 0 | 0 | 50 | 0 | 0 | 0 | 3 | 30.49 | 24,506 |
| J | 65 | 0 | 0 | 35 | 0 | 0 | 0 | 3 | 30.34 | 22,897 |
| K | 28.3 | 28.3 | 0 | 43.3 | 0 | 0 | 0 | 3 | 30.54 | 21,929 |
| L | 65 | 0 | 0 | 35 | 0 | 0 | 0 | 0 | 30.12 | 2,702,200 |
| M | 45 | 0 | 0 | 35 | 0 | 0 | 20 | 2 | 30.42 | 37,808 |
| N | 65 | 0 | 0 | 20 | 15 | 0 | 0 | 2 | 30.47 | 39,995 |
| O | 52.2 | 0 | 0 | 47.8 | 0 | 0 | 0 | 3 | 31 | 24,096 |
| P | 65 | 0 | 0 | 35 | 0 | 0 | 0 | 0.5 | 30.3 | 226,770 |
| Q | 26.1 | 26.1 | 0 | 47.8 | 0 | 0 | 0 | 2 | 30.16 | 33,422 |
| R | 26.1 | 26.1 | 0 | 47.8 | 0 | 0 | 0 | 1.25 | 30.47 | 56,281 |
| S | 58.6 | 0 | 0 | 41.4 | 0 | 0 | 0 | 2 | 30.93 | 31,610 |
| T | 52.2 | 0 | 0 | 47.8 | 0 | 0 | 0 | 0 | 29.7 | 1,914,900 |
| U | 52.2 | 0 | 0 | 47.8 | 0 | 0 | 0 | 0.5 | 29.1 | 161,160 |
| V | 75 | 0 | 0 | 25 | 0 | 0 | 0 | 2 | 31.15 | 37,403 |
| W | 58 | 0 | 0 | 27 | 15 | 0 | 0 | 2 | 29.73 | 37,878 |
| X | 40 | 0 | 0 | 60 | 0 | 0 | 0 | 2 | 30.2 | 52,545 |
| Y | 75 | 0 | 0 | 0 | 25 | 0 | 0 | | | 41,450 |

Acrylic monomers mentioned herein include acrylic acid (AA), methacrylic acid (MAA), ethyl acrylate (EA), n-butyl acrylate (BA), methyl acrylate (MA), lauryl methacrylate (LMA), MA-23 (methacrylate ester of a 23 mole ethoxylate of lauryl alcohol. n-dodecyl mercaptan (nDDM) often is used as a chain transfer agent. Amount of each monomer is calculated as a percent of total monomer amounts (without nDDM) and the amount of nDDM also is given as percent of total monomers, i.e., monomer percentages add to 100 without nDDM.

Witco 90 Flake=anionic sodium dodecyl benzene sulfonate (Linear Alkyl Benzene Sulfonate), 90% actives; NEODOL 25-7 Alcohol Ethoxylate=nonionic $C_{12}$-$C_{15}$-alcohol with an average of approximately 7 moles of ethylene oxide per mole of alcohol, 100% actives. WITCOLATE LES-60C=anionic $C_{12}$-$C_{14}$ (3 Moles EO) Sodium Sulfate, 60% actives EMPICOL ESB 70=anionic $C_{12}$-$C_{14}$ (2 Moles EO) Sodium Sulfate, 70% actives; ACUSOL 820=A hydrophobically modified alkali soluble acrylic polymer emulsion (HASE) which, when neutralized to a pH above 7 by adding alkali, thickens instantly; PRIFAC 7908 by Croda Coatings & Polymers.

Formulations Used for Anti-Redeposition Tests 10.5% Surfactant formulation used for Anti-redeposition Laundry tests.

| Ingredients (in order of addition) | % active | % Active in product |
|---|---|---|
| Deionized Water | | 84.18 |
| Linear alkyl benzene sulfonate (WITCO 90 Flake) | 90.0 | 7.9 |
| Alcohol Ethoxylate (NEODOL 25-7) | 100.0 | 2.6 |
| Propylene Glycol | 100.0 | 3.7 |
| Ethanol | 100.0 | 1.6 |
| 10% NaOH | 10.0 | 0.02 |
| TOTAL (final pH = 8.8) | | 100 |

Final formulation pH adjusted to 8.8

26.0% Surfactant Formulation Used for Anti-Redeposition Laundry Tests.

| Ingredients (in order of addition) | % Active | % Active in product |
|---|---|---|
| Deionized Water | | 66.14 |
| Linear alkyl benzene sulfonate (WITCO 90 Flake) | 90.0 | 7.36 |
| Sodium Alcohol Ethoxylate Sulfate (WITCOLATE LES-60C) | 60.0 | 15.77 |
| Propylene Glycol | 100.0 | 5.26 |
| Ethanol | 100.0 | 2.63 |
| Alcohol Ethoxylate (NEODOL 25-7) | 100.0 | 2.84 |
| 10% NaOH | 10.0 | 0.02 |
| TOTAL (final pH = 8.8) | | 100 |

Final formulation pH adjusted to 8.8

37.4% Surfactant/Soap Formulation for Anti-Redeposition Laundry Tests.

| Ingredients (in order of addition) | % Active | % Active in product |
|---|---|---|
| Deionized Water | | 50.19 |
| WITCO 90 Flake | 90.0 | 18.44 |
| WITCOLATE LES-60C | 60.0 | 0.0 |
| NEODOL 25-7 | 100.0 | 10.68 |
| Sodium Citrate•$2H_2O$ | 100.0 | 1.94 |
| Propylene Glycol | 100.0 | 4.85 |
| PRIFAC 7908 fatty acid soap (palm kernel fatty acid) | 100.0 | 8.25 |
| Ethanol | 100.0 | 1.94 |
| Sodium Xylene Sulfonate | 93.0 | 2.44 |
| 10% NaOH | 10.0 | 1.26 |
| TOTAL (pH = 8.5) | | 100.0 |

Final formulation pH adjusted to 8.5

35.6% Surfactant/Soap Formulation with Rheology Modifier for Anti-Redeposition Laundry Tests

| Ingredients (in order of addition) | % Active | % active in product |
|---|---|---|
| Deionized Water | | 51.4 |
| WITCO 90 Flake | 90.0 | 17.6 |
| WITCOLATE LES-60C | 60.0 | 0.0 |
| NEODOL 25-7 | 100.0 | 10.2 |
| Sodium Citrate•$2H_2O$ | 100.0 | 1.9 |
| Propylene Glycol | 100.0 | 4.6 |
| Ethanol | 100.0 | 1.9 |
| Sodium Xylene Sulfonate (SXS)* | 93.0 | 2.3 |
| PRIFAC 7908 soap (palm kernel fatty acid) | 100.0 | 7.9 |
| ACUSOL 820 Rheology Modifier | 29.88 | 0.8 |
| 10% NaOH (pH = 8.5) | 10.0 | 1.4 |
| TOTAL | | 100 |

*The SXS was a solid powder

Anti-Redeposition Laundry Results

Experiment 571

Initial Laundering Conditions:

Total water volume of 1 liter. 1.0 grams of 37.4% surfactant added (1.0 gram/Liter), 1.0 grams of 1% active polymer solution added (10 ppm concentration), 20° C. washing conditions, 300 ppm total water hardness (2/1, $Ca^{+2}/Mg^{+2}$), US Testing Tergotometer, 60 minute wash, 3 minute rinse (cold tap water), tumble dry, two 8.9×11.4 cm Cotton, two 8.9×11.4 cm PE/Cotton, two 8.9×11.4 cm Polyester and two 8.9×11.4 cm Cotton Interlock (all from Test Fabrics). 2.5 grams Dust Sebum Emulsion (courtesy Scientific Services) and 2.5 grams of 25% Big Oak Clay Slurry added at the start of each wash (Big Oak Clay is an orange colored, high content iron clay found locally in Pennsylvania). All cloths were stripped by washing 3× in PUREX FREE CLEAR detergent base prior to the experiment. Whiteness index-WIE313 (Average of 4 values from Hunter Lab Colorimeter) after 16 cycles total:

| Swatch type | Polymer | Average Whiteness |
|---|---|---|
| Cotton | No Polymer | 68.7 |
| Cotton | Comp. AA | 67.7 |
| Cotton | C | 72.5 |
| Cotton | I | 70.8 |
| Cotton | J | 72.3 |
| Cotton | K | 70.4 |
| Cotton Interlock | No Polymer | 58.5 |
| Cotton Interlock | Comp. AA | 60.3 |
| Cotton Interlock | C | 63.1 |
| Cotton Interlock | I | 63.2 |

-continued

| Swatch type | Polymer | Average Whiteness |
|---|---|---|
| Cotton Interlock | J | 64.2 |
| Cotton Interlock | K | 61.7 |
| Poly-cotton | No Polymer | 70.8 |
| Poly-cotton | Comp. AA | 70.7 |
| Poly-cotton | C | 73.3 |
| Poly-cotton | I | 73.9 |
| Poly-cotton | J | 75.0 |
| Poly-cotton | K | 72.4 |
| Polyester | No Polymer | 64.1 |
| Polyester | Comp. AA | 66.1 |
| Polyester | C | 65.0 |
| Polyester | I | 64.9 |
| Polyester | J | 66.5 |
| Polyester | K | 61.9 |

C-52.2% EA/47.8% MAA w/2% nDDM, 33,360 Mw, 5,800 Mn;
I-50% EA/50% MAA w/3.0% nDDM, 24,506 Mw, 4,450 Mn;
J-65% EA/35% MAA w/3.0% nDDM, 22,897 Mw, 4,124 Mn;
K-28.3% EA/28.3% BA/43.3% MAA w/3.0% nDDM, 21,929 Mw, 4,001 Mn;
Comp. AA-100% AA, 7,500 Mw, 2,297 Mn (Comparative).

35.6% Surfactant Formulation with Rheology Modifier (ACUSOL 820)

Experiment 574

Initial Laundering Conditions:

Total water volume of 1 liter. 1.0 grams of 35.6% surfactant added (1.0 gram/Liter), 1.0 grams of 1% active polymer solution added (10 ppm concentration), 20° C. washing conditions, 300 ppm total water hardness (2/1 $Ca^{+2}/Mg^{+2}$), US Testing Tergotometer, 60 minute wash, 3 minute rinse (cold tap water), tumble dry, two 8.9×11.4 cm Cotton, two 8.9×11.4 cm PE/Cotton, two 8.9×11.4 cm Polyester and two 8.9×11.4 cm Cotton Interlock (all from Test Fabrics). 2.5 grams Dust Sebum Emulsion (courtesy Scientific Services) and 2.5 grams of 25% Big Oak Clay Slurry added at the start of each wash. All cloths were stripped by washing 3× in PUREX FREE CLEAR detergent base prior to the experiment Whiteness index-WIE313 (Average of 4 values from Hunter Lab Colorimeter) after 3 cycles total:

| Swatch type | Polymer | Average Whiteness |
|---|---|---|
| Cotton | No Polymer | 47.5 |
| Cotton | Comp. AA | 63.6 |
| Cotton | C | 67.9 |
| Cotton | E | 61.9 |
| Cotton | F | 67.1 |
| Cotton | G | 69.8 |
| Cotton Interlock | No Polymer | 57.1 |
| Cotton Interlock | Comp. AA | 68.9 |
| Cotton Interlock | C | 71.5 |
| Cotton Interlock | E | 67.3 |
| Cotton Interlock | F | 71.5 |
| Cotton Interlock | G | 73.2 |
| Poly-cotton | No Polymer | 60.0 |
| Poly-cotton | Comp. AA | 70.4 |
| Poly-cotton | C | 73.7 |
| Poly-cotton | E | 69.4 |
| Poly-cotton | F | 73.9 |
| Poly-cotton | G | 76.3 |
| Polyester | No Polymer | 55.1 |
| Polyester | Comp. AA | 62.3 |
| Polyester | C | 69.0 |
| Polyester | E | 63.1 |
| Polyester | F | 68.8 |
| Polyester | G | 71.7 |

C-52.2% EA/47.8% MAA w/2% nDDM, 33,360 Mw;
E-28.3% EA/28.3% BA/43.3% MAA w/1.25% nDDM, 54,472 Mw;
F-50% EA/50% MAA w/1.5% nDDM, 51,080 Mw.
G-65% EA/35% MAA w/1.3% nDDM, 56,101 Mw.

35.6% Surfactant Formulation with Rheology Modifier (ACUSOL 820)

Experiment 575

Initial Laundering Conditions: Total water volume of 1 liter. 1.0 grams of 35.6% surfactant added (1.0 gram/Liter), 1.0 grams of 1% active polymer solution added (10 ppm concentration), 20° C. washing conditions, 300 ppm total water hardness (2/1 $Ca^{+2}/Mg^{+2}$), US Testing Tergotometer, 60 minute wash, 3 minute rinse (cold tap water), tumble dry, two 8.9×11.4 cm Cotton, two 8.9×11.4 cm PE/Cotton, two 8.9×11.4 cm Polyester and two 8.9×11.4 cm Cotton Interlock (all from Test Fabrics). 2.5 grams Dust Sebum Emulsion (courtesy Scientific Services) and 2.5 grams of 25% Big Oak Clay Slurry added at the start of each wash. All cloths were stripped by washing 3× in PUREX FREE CLEAR detergent base prior to the experiment Whiteness index-WIE313 (avg. of 4 values from Hunter Lab Colorimeter) after 3 cycles total:

| Swatch type | Polymer | Average Whiteness |
|---|---|---|
| Cotton | No Polymer | 46.405 |
| Cotton | Comp. AA | 66.665 |
| Cotton | B | 63.24 |
| Cotton | C | 66.25 |
| Cotton | D | 70.025 |
| Cotton | H | 61.22 |
| Cotton Interlock | No Polymer | 59.41 |
| Cotton Interlock | Comp. AA | 73.135 |
| Cotton Interlock | B | 72.68 |
| Cotton Interlock | C | 73.62 |
| Cotton Interlock | D | 74.955 |
| Cotton Interlock | H | 71.24 |
| Poly-cotton | No Polymer | 60.565 |
| Poly-cotton | Comp. AA | 71.89 |
| Poly-cotton | B | 71.86 |
| Poly-cotton | C | 74.385 |
| Poly-cotton | D | 76.365 |
| Poly-cotton | H | 69.28 |
| Polyester | No Polymer | 54.51 |
| Polyester | Comp. AA | 63.045 |
| Polyester | B | 64.3 |
| Polyester | C | 68.2 |
| Polyester | D | 72.79 |
| Polyester | H | 60.98 |

Sample compositions:
B-28.3% EA/28.3% BA/43.3% MAA w/2% nDDM, 35,152 Mw;
C-52.2% EA/47.8% MAA w/2% nDDM, 33,360 Mw;
D-65% EA/35% MAA w/2% nDDM, 31,771 Mw.
H-40% EA/50% MAA/10% LMA w/2% nDDM, 103,790 Mw.

35.6% Surfactant Formulation with Rheology Modifier (ACUSOL 820)

Experiment 576

Initial Laundering Conditions:

Total water volume of 1 liter. 1.0 grams of 35.6% surfactant added (1.0 gram/Liter), 1.0 grams of 1% active polymer solution added (10 ppm concentration), 20° C. washing conditions, 300 ppm total water hardness (2/1 $Ca^{+2}/Mg^{+2}$), US Testing Tergotometer, 60 minute wash, 3 minute rinse (cold tap water), tumble dry, two 8.9×11.4 cm Cotton, two 8.9×11.4 cm PE/Cotton, two 8.9×11.4 cm Polyester and two 8.9×11.4 cm Cotton Interlock (all from Test Fabrics). 2.5 grams Dust Sebum Emulsion (courtesy Scientific Services) and 2.5 grams of 25% Big Oak Clay Slurry added at the start of each wash. All cloths were stripped by washing 3× in PUREX FREE CLEAR detergent base prior to the experiment.

Whiteness index-WIE313 (avg. of 4 values from Hunter Lab Colorimeter) after 3 cycles total:

| Swatch type | Polymer | Average Whiteness |
|---|---|---|
| Cotton | No Polymer | 51.9 |
| Cotton | Comp. AA | 62.1 |
| Cotton | I | 65.3 |
| Cotton | J | 69.6 |
| Cotton | Comp. A | 57.3 |
| Cotton | Comp. B | 63.7 |
| Cotton Interlock | No Polymer | 59.2 |
| Cotton Interlock | Comp. AA | 69.9 |
| Cotton Interlock | I | 71.6 |
| Cotton Interlock | J | 73.8 |
| Cotton Interlock | Comp. A | 68.4 |
| Cotton Interlock | Comp. B | 69.9 |
| Poly-cotton | No Polymer | 60.7 |
| Poly-cotton | Comp. AA | 70.9 |
| Poly-cotton | I | 74.8 |
| Poly-cotton | J | 76.0 |
| Poly-cotton | Comp. A | 67.9 |
| Poly-cotton | Comp. B | 71.4 |
| Polyester | No Polymer | 53.6 |
| Polyester | Comp. AA | 62.4 |
| Polyester | I | 67.0 |
| Polyester | J | 71.3 |
| Polyester | Comp. A | 59.9 |
| Polyester | Comp. B | 63.0 |

I-50% EA/50% MAA w/3.0% nDDM, 24,506 Mw;
J-65% EA/35% MAA w/3.0% nDDM, 22,897 Mw; Comp.
A-80% AA/20% EA, 21,000 Mw. (Comparative)
Comp. B-90% AA/10% EA, 18,929 Mw. (Comparative)

Experiment 577

Initial Laundering Conditions:

Total water volume of 1 liter. 1.0 grams of 35.6% surfactant added (1.0 gram/Liter), 1.0 grams of 1% active polymer solution added (10 ppm concentration), 20° C. washing conditions, 300 ppm total water hardness (2/1 $Ca^{+2}/Mg^{+2}$), US Testing Tergotometer, 60 minute wash, 3 minute rinse (cold tap water), tumble dry, two 8.9×11.4 cm Cotton, two 8.9×11.4 cm PE/Cotton, two 8.9×11.4 cm Polyester and two 8.9×11.4 cm Cotton Interlock (all from Test Fabrics). 2.5 grams Dust Sebum Emulsion (courtesy Scientific Services) and 2.5 grams of 25% Big Oak Clay Slurry added at the start of each wash. All cloths were stripped by washing 3× in PUREX FREE CLEAR detergent base prior to the experiment.

Whiteness index-WIE313 (avg. of 4 values from Hunter Lab Colorimeter) after 2 cycles total:

| Swatch type | Polymer | Average Whiteness |
|---|---|---|
| Cotton | No Polymer | 46.97 |
| Cotton | Comp. AA | 63.72 |
| Cotton | C | 69.53 |
| Cotton | I | 69.87 |
| Cotton | J | 70.48 |
| Cotton | K | 64.12 |
| Poly-cotton | No Polymer | 58.21 |
| Poly-cotton | Comp. AA | 70.17 |
| Poly-cotton | C | 74.51 |
| Poly-cotton | I | 75.37 |
| Poly-cotton | J | 76.14 |
| Poly-cotton | K | 70.32 |
| Cotton Interlock | No Polymer | 59.39 |
| Cotton Interlock | Comp. AA | 70.90 |
| Cotton Interlock | C | 73.89 |
| Cotton Interlock | I | 72.69 |
| Cotton Interlock | J | 75.11 |
| Cotton Interlock | K | 70.28 |
| Polyester | No Polymer | 42.10 |
| Polyester | Comp. AA | 53.63 |
| Polyester | C | 64.96 |

-continued

| Swatch type | Polymer | Average Whiteness |
|---|---|---|
| Polyester | I | 61.96 |
| Polyester | J | 68.31 |
| Polyester | K | 55.06 |

C-52.2% EA/47.8% MAA w/2% nDDM, 33,360 Mw; I-50% EA/50% MAA w/3.0% nDDM, 24,506 Mw; J-65% EA/35% MAA w/3.0% nDDM, 22,897 Mw; K-28.3% EA/28.3% BA/43.3% MAA w/3.0% nDDM, 21,929 Mw.

35.6% Surfactant Formulation with Rheology Modifier (ACUSOL 820)

Experiment 578

Initial Laundering Conditions:

Total water volume of 1 liter. 1.0 grams of 35.6% surfactant added (1.0 gram/Liter), 1.0 grams of 1% active polymer solution added (10 ppm concentration), 20° C. washing conditions, 300 ppm total water hardness (2/1 $Ca^{+2}/Mg^{+2}$), US Testing Tergotometer, 60 minute wash, 3 minute rinse (cold tap water), tumble dry, two 8.9×11.4 cm Cotton, two 8.9×11.4 cm PE/Cotton, two 8.9×11.4 cm Polyester and two 8.9×11.4 cm Cotton Interlock (all from Test Fabrics). 2.5 grams Dust Sebum Emulsion (courtesy Scientific Services) and 2.5 grams of 25% Big Oak Clay Slurry added at the start of each wash. All cloths were stripped by washing 3× in PUREX FREE CLEAR detergent base prior to the experiment.

Whiteness index-WIE313 (avg. of 4 values from Hunter Lab Colorimeter) after 2 cycles total:

| Swatch type | Polymer | Average Whiteness |
|---|---|---|
| Cotton | No Polymer | 44.2 |
| Cotton | Comp. AA | 64.39 |
| Cotton | B | 59.05 |
| Cotton | C | 67.63 |
| Cotton | D | 67.91 |
| Cotton | H | 56.70 |
| Cotton Interlock | No Polymer | 59.85 |
| Cotton Interlock | Comp. AA | 69.3 |
| Cotton Interlock | B | 70.19 |
| Cotton Interlock | C | 73.73 |
| Cotton Interlock | D | 76.24 |
| Cotton Interlock | H | 69.21 |
| Poly-cotton | No Polymer | 55.08 |
| Poly-cotton | Comp. AA | 69.69 |
| Poly-cotton | B | 66.06 |
| Poly-cotton | C | 73.74 |
| Poly-cotton | D | 76.57 |
| Poly-cotton | H | 65.77 |
| Polyester | No Polymer | 40.05 |
| Polyester | Comp. AA | 55.21 |
| Polyester | B | 52.34 |
| Polyester | C | 64.27 |
| Polyester | D | 67.79 |
| Polyester | H | 50.86 |

B-28.3% EA/28.3% BA/43.3% MAA w/2% nDDM, 35,152 Mw;
C-52.2% EA/47.8% MAA w/2% nDDM, 33,360 Mw;
D-65% EA/35% MAA w/2% nDDM, 31,771 Mw.
H-40% EA/50% MAA/10% LMA w/2% nDDM, 103,790 Mw.

Experiment 579

Formulation Stability experiments for 10.0% Surfactant formulation with 1% polymer solids. Final formulation equals pH 8.5.

10% Surfactant Formulation Used for Formulation Stability Tests.

| Ingredients (in order of addition) | % active | % Active in product |
|---|---|---|
| Deionized Water | | 83.8 |
| Linear alkyl benzene sulfonate (WITCO 90 Flake) | 90.0 | 7.5 |
| Alcohol Ethoxylate (NEODOL 25-7) | 100.0 | 2.5 |
| Propylene Glycol | 100.0 | 3.5 |
| Ethanol | 100.0 | 1.5 |
| Polymer | variable | 1.0 |
| 10% NaOH | 10.0 | 0.2 |
| TOTAL (final pH = 8.5) | | 100 |

Formulation pH adjusted to 8.5 with 10% NaOH.

Note:

Initial observations show that the above 16 samples appear clear & stable with a yellow tint.

Stability Data after 2 weeks at conditions described in the table

| | Sample Description | Room temp. | 4° C. | 45° C. oven |
|---|---|---|---|---|
| 1) | 10% surfactant base no polymer (DI water added) | Stable | Stable | Stable |
| 2) | 10% surfactant base w/Comp. AA | Stable | Stable | Stable |
| 3) | 10% surfactant base w/B | Stable | Stable | Stable |
| 4) | 10% surfactant base w/C | Stable | Stable | Stable |
| 5) | 10% surfactant base w/D | Stable | Stable | Stable |
| 6) | 10% surfactant base w/E | Stable | Stable | Stable |
| 7) | 10% surfactant base w/F | Stable | Stable | Stable |
| 8) | 10% surfactant base w/G | Stable | Stable | Stable |
| 9) | 10% surfactant base w/H | Stable | Stable | Stable |
| 10) | 10% surfactant base w/I | Stable | Stable | Stable |
| 11) | 10% surfactant base w/J | Stable | Stable | Stable |
| 12) | 10% surfactant base w/K | Stable | Stable | Stable |
| 13) | 10% surfactant base w/Comp. A | Stable | Stable | Stable |
| 14) | 10% surfactant base w/Comp. B | Stable | Stable | Stable |
| 15) | 10% surfactant base w/Comp. C | Stable | Stable | Stable |
| 16) | 10% surfactant base w/Comp. D | Stable | Stable | Stable |

Stable = single clear phase observed with no precipitation or inhomogeneity

Phase Separated: A second liquid layer is observed at the bottom of the vessel, indicating some phase incompatibility between the ingredients.

Stability Data after 4 weeks at conditions described in the table

| | Sample Description | room temp. | 4° C. | 45° C. oven | room temp. turbidity (NTU) | 4° C. turbidity (NTU) | 45° C. turbidity (NTU) |
|---|---|---|---|---|---|---|---|
| 1) | 10% surfactant base w/ DI water only | stable | stable | stable | 1.4 | 1.8 | 0.6 |
| 2) | 10% surfactant base w/ Comp. AA | stable | stable | stable | 3.0 | 2.9 | 1.1 |
| 3) | 10% surfactant base w/ B | stable | stable | stable | 1.3 | 1.5 | 1.8 |

-continued

| Sample Description | room temp. | 4° C. | 45° C. oven | room temp. turbidity (NTU) | 4° C. turbidity (NTU) | 45° C. turbidity (NTU) |
|---|---|---|---|---|---|---|
| 4) 10% surfactant base w/ C | stable | stable | stable | 0.9 | 0.7 | 0.8 |
| 5) 10% surfactant base w/ D | stable | stable | stable | 1.2 | 1.1 | 1.6 |
| 6) 10% surfactant base w/ E | stable | stable | stable | 1.6 | 2.0 | 1.5 |
| 7) 10% surfactant base w/ F | stable | stable | stable | 2.4 | 3.3 | 2.5 |
| 8) 10% surfactant base w/ G | stable | stable | stable | 1.9 | 2.6 | 1.8 |
| 9) 10% surfactant base w/ H | stable | stable | stable | 3.0 | 3.9 | 1.7 |
| 10) 10% surfactant base w/ I | stable | stable | stable | 1.8 | 1.2 | 1.4 |
| 11) 10% surfactant base w/ J | stable | stable | stable | 0.8 | 1.1 | 1.6 |
| 12) 10% surfactant base w/ K | stable | stable | stable | 0.9 | 1.5 | 0.1 |
| 13) 10% surfactant base w/ Comp. A | stable | stable | stable | 4.5 | 5.5 | 4.0 |
| 14) 10% surfactant base w/ Comp. B | stable | stable | stable | 4.7 | 4.1 | 4.1 |
| 15) 10% surfactant base w/ Comp. C | stable | stable | stable | 4.7 | 5.1 | 3.9 |
| 16) 10% surfactant base w/ Comp. D | stable | stable | stable | 4.2 | 5.1 | 4.4 |

Stable = single clear phase observed with no precipitation or inhomogeneity

Phase Separated: A second liquid layer is observed at the bottom of the vessel, indicating some phase incompatibility between the ingredients.

NTU = Nephelometric Turbidity Units measured on a HF Instruments Model DRt 100.

Sample key:

B-28.3% EA/28.3% BA/43.3% MAA w/ 2% nDDM, 35,152 Mw;

C-52.2% EA/47.8% MAA w/ 2% nDDM, 33,360 Mw;

D-65% EA/35% MAA w/ 2% nDDM, 31,771 Mw;

E-28.3% EA/28.3% BA/43.3% MAA w/ 1.25% nDDM, 54,472 Mw;

F-50% EA/50% MAA w/ 1.5% nDDM, 51,080 Mw;

G-65% EA/35% MAA w/ 1.3% nDDM, 56,101 Mw.

H-40% EA/50% MAA/10% LMA w/ 2% nDDM, 103,790 Mw;

I-50% EA/50% MAA w/ 3.0% nDDM, 24,506 Mw;

J-65% EA/35% MAA w/ 3.0% nDDM, 22,897 Mw.

K-28.3% EA/28.3% BA/43.3% MAA w/ 3% nDDM, 21,929 Mw;

Comp. A-80% AA/20% EA, 21,000 Mw;

Comp. B-90% AA/10% EA, 18,929 Mw;

Comp. C-80% AA/20% EA, 25,372 Mw;

Comp. D-90% AA/10% EA, 27,935 Mw.

Experiment 580

Formulation Stability experiments for 24.7% Surfactant formulation with 1% polymer solids. Final formulation equals pH 8.5.

Note: Initial observations show that samples 1 & 3 thru 12 are clear & stable with slight yellow tint. Sample 2 was initially cloudy but became clear within 24 hours. Samples 13 thru 16 are slightly cloudy.

24.7% Surfactant Formulation Used Formulation Stability Tests.

| Ingredients (in order of addition) | % Active | % Active in product |
|---|---|---|
| Deionized Water | | 66.6 |
| Linear alkyl benzene sulfonate (WITCO 90 Flake) | 90.0 | 7.0 |
| Sodium Alcohol Ethoxylate Sulfate (WITCOLATE LES-60C) | 60.0 | 15.0 |
| Propylene Glycol | 100.0 | 5.00 |
| Ethanol | 100.0 | 2.5 |
| Alcohol Ethoxylate (NEODOL 25-7) | 100.0 | 2.70 |
| Polymer | Variable | 1.00 |
| 10% NaOH | 10.0 | 0.2 |
| TOTAL (final pH = 8.5) | | 100 |

Formulation pH adjusted to 8.5 with 10% NaOH.

Stability Data after 2 weeks at conditions described in the table

| Sample Description | room temp. | 4° C. | 45° C. |
|---|---|---|---|
| 1) 24.7% surfactant base w/ DI water only | Stable | Stable | Stable |
| 2) 24.7% surfactant base w/ Comp. AA | Phase sep. | Phase sep. | Stable |
| 3) 24.7% surfactant base w/B | Stable | Stable | Stable |
| 4) 24.7% surfactant base w/C | Stable | Stable | Stable |
| 5) 24.7% surfactant base w/D | Stable | Stable | Stable |
| 6) 24.7% surfactant base w/E | Stable | Stable | Stable |
| 7) 24.7% surfactant base w/F | Stable | Stable | Stable |
| 8) 24.7% surfactant base w/G | Stable | Stable | Stable |
| 9) 24.7% surfactant base w/H | Stable | Stable | Stable |
| 10) 24.7% surfactant base w/I | Stable | Stable | Stable |
| 11) 24.7% surfactant base w/J | Stable | Stable | Stable |
| 12) 24.7% surfactant base w/K | Stable | Stable | Stable |
| 13) 24.7% surfactant base w/Comp. A | Phase sep. | Phase sep. | Stable |
| 14) 24.7% surfactant base w/Comp. B | Phase sep. | Phase sep. | Stable |
| 15) 24.7% surfactant base w/Comp. C | Phase sep. | Phase sep. | Stable |
| 16) 24.7% surfactant base w/Comp. D | Phase sep. | Phase sep. | Phase sep. |

Stable = single clear phase observed with no precipitation or inhomogeneity

Phase Separated: A second liquid layer is observed at the bottom of the vessel, indicating some phase incompatibility between the ingredients.

Stability Data after 4 weeks at conditions described in the table

| Sample Description | room temp. | (4° C.) | 45° C. oven | Room temp. turbidity (NTU) | 4° C. turbidity (NTU) | 45° C. turbidity (NTU) |
|---|---|---|---|---|---|---|
| 1) 24.7% surfactant base w/ DI water only | stable | stable | stable | <0.1 | <0.1 | <0.1 |
| 2) 24.7% surfactant base w/ Comp. AA | phase sep. | phase sep. | stable | N/A | N/A | N/A |
| 3) 24.7% surfactant base w/B | stable | stable | stable | 0.25 | <0.1 | 0.13 |
| 4) 24.7% surfactant base w/C | stable | stable | stable | 0.43 | <0.1 | 0.31 |
| 5) 24.7% surfactant base w/D | stable | stable | stable | <0.1 | 0.41 | <0.1 |
| 6) 24.7% surfactant base w/E | stable | stable | stable | <0.1 | 0.28 | 0.31 |
| 7) 24.7% surfactant base w/F | stable | stable | stable | <0.1 | <0.1 | <0.1 |
| 8) 24.7% surfactant base w/G | stable | stable | stable | 0.4 | <0.1 | 0.39 |
| 9) 24.7% surfactant base w/H | stable | stable | stable | 0.25 | 0.59 | <0.1 |
| 10) 24.7% surfactant base w/I | stable | stable | stable | <0.1 | <0.1 | <0.1 |
| 11) 24.7% surfactant base w/J | stable | stable | stable | 0.52 | <0.1 | <0.1 |
| 12) 24.7% surfactant base w/K | stable | stable | stable | <0.1 | <0.1 | 0.24 |
| 13) 24.7% surfactant base w/Comp. A | phase sep. | phase sep. | stable | N/A | N/A | <0.1 |
| 14) 24.7% surfactant base w/Comp. B | phase sep. | phase sep. | stable | N/A | N/A | <0.1 |
| 15) 24.7% surfactant base w/Comp. C | phase sep. | phase sep. | stable | N/A | N/A | <0.1 |
| 16) 24.7% surfactant base w/Comp. D | phase sep. | phase sep. | phase sep. | N/A | N/A | N/A |

Stable = single clear phase observed with no precipitation or inhomogeneity

Phase Separated (phase sep.): A second liquid layer is observed at the bottom of the vessel, indicating some phase incompatibility between the ingredients.

N/A = not applicable

Sample key:

B-28.3% EA/28.3% BA/43.3% MAA w/ 2% nDDM, 35,152 Mw;

C-52.2% EA/47.8% MAA w/ 2% nDDM, 33,360 Mw;

D-65% EA/35% MAA w/ 2% nDDM, 31,771 Mw;

E-28.3% EA/28.3% BA/43.3% MAA w/ 1.25% nDDM, 54,472 Mw;

F-50% EA/50% MAA w/ 1.5% nDDM, 51,080 Mw;

G-65% EA/35% MAA w/ 1.3% nDDM, 56,101 Mw;

H-40% EA/50% MAA/10% LMA w/ 2% nDDM, 103,790 Mw;

I-50% EA/50% MAA w/ 3.0% nDDM, 24,506 Mw;

J-65% EA/35% MAA w/ 3.0% nDDM, 22,897 Mw.

K-28.3% EA/28.3% BA/43.3% MAA w/ 3% nDDM, 21,929 Mw;

Comp. A-80% AA/20% EA, 21,000 Mw;

Comp. B-90% AA/10% EA, 18,929 Mw;

Comp. C-80% AA/20% EA, 25,372 Mw;

Comp. D-90% AA/10% EA, 27,935 Mw.

Experiment 581

32.3% Surfactant/Soap Formulation with Rheology Modifier for Formulation Stability Tests.

| Ingredients (in order of addition) | % Active | % active in product |
|---|---|---|
| Deionized Water | | 54.94 |
| WITCO 90 Flake | 90.0 | 16.0 |
| WITCOLATE LES-60C | 60.0 | 0.0 |
| NEODOL 25-7 | 100.0 | 9.2 |
| Sodium Citrate•$2H_2O$ | 100.0 | 1.7 |
| Propylene Glycol | 100.0 | 4.2 |
| Ethanol | 100.0 | 1.7 |
| Sodium Xylene Sulfonate | 93.0 | 2.1 |
| PRIFAC 7908 soap (palm kernel fatty acid) | 100.0 | 7.1 |
| ACUSOL 820 Rheology Modifier | 29.88 | 0.76 |
| Polymer | variable | 1.0 |
| 10% NaOH (pH = 8.5) | 10.0 | 1.3 |
| TOTAL | | 100 |

Formulation pH adjusted to 8.5 with 10% NaOH.

Formulation Stability experiments for 32.3% surfactant plus fatty soap formulation with 1% polymer solids. Final formulation equals pH 8.5.

Note: Initial observations show that samples 1 & 3 thru 12 are clear & stable with more yellow color than Exs. 0579 & 0580. Samples 2 & 13 thru 16 are very cloudy.

Stability Data after 2 weeks at conditions described in the table

| Sample# | room temp. | (4° C.) | 45° C. oven |
|---|---|---|---|
| 1) 32.3% surfactant base w/DI water only | Stable | Stable | Stable |
| 2) 32.3% surfactant base w/Comp. AA | phase sep. | phase sep. | phase sep. |
| 3) 32.3% surfactant base w/B | Stable | Stable | Stable |
| 4) 32.3% surfactant base w/C | Stable | Stable | Stable |
| 5) 32.3% surfactant base w/D | Stable | Stable | Stable |
| 6) 32.3% surfactant base w/E | Stable | Stable | Stable |
| 7) 32.3% surfactant base w/F | Stable | Stable | Stable |
| 8) 32.3% surfactant base w/G | Stable | Stable | Stable |
| 9) 32.3% surfactant base w/H | Stable | Stable | Stable |
| 10) 32.3% surfactant base w/I | Stable | Stable | Stable |
| 11) 32.3% surfactant base w/J | Stable | Stable | Stable |
| 12) 32.3% surfactant base w/K | Stable | Stable | Stable |
| 13) 32.3% surfactant base w/Comp. A | phase sep. | phase sep. | phase sep. |
| 14) 32.3% surfactant base w/Comp. B | phase sep. | phase sep. | phase sep. |
| 15) 32.3% surfactant base w/Comp. C | phase sep. | phase sep. | phase sep. |
| 16) 32.3% surfactant base w/Comp. D | phase sep. | phase sep. | phase sep. |

Stable = single clear phase observed with no precipitation or inhomogeneity

Phase Separated: A second liquid layer is observed at the bottom of the vessel, indicating some phase incompatibility between the ingredients.

Stability Data after 4 weeks at conditions described in the table

| | surfactant level/ polymer | room temp. | 4° C. | 45° C. oven | room temp. turbidity (NTU) | 4° C. turbidity (NTU) | 45° C. turbidity (NTU) |
|---|---|---|---|---|---|---|---|
| 1) | 32.3%/ DI water only | stable | stable | stable | 31.3 | 38.1 | 23.6 |
| 2) | 32.3%/ Comp. AA | phase sep. | phase sep. | phase sep. | N/A | N/A | N/A |
| 3) | 32.3%/B | stable | stable | stable | 35.1 | 51.6 | 23.4 |
| 4) | 32.3%/C | stable | stable | stable | 15.1 | 23.9 | 16.8 |
| 5) | 32.3%/D | stable | stable | stable | 23.3 | 39.5 | 21.9 |
| 6) | 32.3%/E | stable | stable | stable | 38.3 | 54.5 | 33.9 |
| 7) | 32.3%/F | stable | stable | stable | 20.5 | 24.2 | 18.1 |
| 8) | 32.3%/G | stable | stable | stable | 26.2 | 35.7 | 28.1 |
| 9) | 32.3%/H | stable | stable | stable | 23.1 | 24.7 | 17.9 |
| 10) | 32.3%/I | stable | stable | stable | 26.4 | 30.1 | 18.8 |
| 11) | 32.3%/J | stable | stable | stable | 32.7 | 38.5 | 19.3 |
| 12) | 32.3%/K | stable | stable | stable | 28.9 | 43.6 | 33.1 |
| 13) | 32.3%/ Comp. A | phase sep. | phase sep. | phase sep. | N/A | N/A | N/A |
| 14) | 32.3%/ Comp. B | phase sep. | phase sep. | phase sep. | N/A | N/A | N/A |
| 15) | 32.3%/ Comp. C | phase sep. | phase sep. | phase sep. | N/A | N/A | N/A |
| 16) | 32.3%/ Comp. D | phase sep. | phase sep. | phase sep. | N/A | N/A | N/A |

stable = single clear phase observed with no precipitation or inhomogeneity

Phase Separated: A second liquid layer is observed at the bottom of the vessel, indicating some phase incompatibility between the ingredients.

Sample key:

B-28.3% EA/28.3% BA/43.3% MAA w/ 2% nDDM, 35,152 Mw;
C-52.2% EA/47.8% MAA w/ 2% nDDM, 33,360 Mw;
D-65% EA/35% MAA w/ 2% nDDM, 31,771 Mw.
E-28.3% EA/28.3% BA/43.3% MAA w/ 1.25% nDDM, 54,472 Mw;
F-50% EA/50% MAA w/ 1.5% nDDM, 51,080 Mw;
G-65% EA/35% MAA w/ 1.3% nDDM, 56,101 Mw.
H-40% EA/50% MAA/10% LMA w/ 2% nDDM, 103,790 Mw;
I-50% EA/50% MAA w/ 3.0% nDDM, 24,506 Mw;
J-65% EA/35% MAA w/ 3.0% nDDM, 22,897 Mw;
K-28.3% EA/28.3% BA/43.3% MAA w/ 3% nDDM, 21,929 Mw;
Comp. A-80% AA/20% EA, 21,000 Mw;
Comp. B-90% AA/10% EA, 18,929 Mw;
Comp. C-80% AA/20% EA, 25,372 Mw;
Comp. D-90% AA/10% EA, 27,935 Mw.

Experiment 588

Whiteness index-WIE313 (avg. of 4 values from Hunter Lab Colorimeter) after 2 cycles total:

Initial Laundering Conditions:

Total water volume of 1 liter. 1.0 grams of 10.5% surfactant added (1.0 gram/Liter), 1.0 grams of 1% active polymer solution added (10 ppm concentration), 20° C. washing conditions, 300 ppm total water hardness (2/1 $Ca^{+2}/Mg^{+2}$), US Testing Tergotometer, 12 minute wash, 3 minute rinse (cold tap water), tumble dry, two 8.9×11.4 cm Cotton, two 8.9×11.4 cm PE/Cotton, two 8.9×11.4 cm Polyester and two 8.9×11.4 cm Cotton Interlock (all from Test Fabrics). 2.5 grams Dust Sebum Emulsion (courtesy Scientific Services) and 2.5 grams of 25% Big Oak Clay Slurry added at the start of each wash. All cloths were stripped by washing 3× in PUREX FREE CLEAR detergent base prior to the experiment.

Note: The results below were obtained from a Hunter Lab Colorimeter.

| Swatch type | Polymer | Average |
|---|---|---|
| Cotton | No Polymer | 54.3 |
| Cotton | Comp. AA | 64.7 |
| Cotton | B | 61.5 |

-continued

| Swatch type | Polymer | Average |
|---|---|---|
| Cotton | C | 74.4 |
| Cotton | D | 78.5 |
| Cotton | H | 65.0 |
| Poly-cotton | No Polymer | 75.2 |
| Poly-cotton | Comp. AA | 76.7 |
| Poly-cotton | B | 75.4 |
| Poly-cotton | C | 80.3 |
| Poly-cotton | D | 81.2 |
| Poly-cotton | H | 76.4 |
| Cotton Interlock | No Polymer | 70.0 |
| Cotton Interlock | Comp. AA | 72.0 |
| Cotton Interlock | B | 73.5 |
| Cotton Interlock | C | 77.6 |
| Cotton Interlock | D | 79.6 |
| Cotton Interlock | H | 70.6 |
| Polyester | No Polymer | 55.2 |
| Polyester | Comp. AA | 63.1 |
| Polyester | B | 54.9 |
| Polyester | C | 69.1 |
| Polyester | D | 68.1 |
| Polyester | H | 58.6 |

Sample compositions:

B-28.3% EA/28.3% BA/43.3% MAA w/2% nDDM, 35,152 Mw;
C-52.2% EA/47.8% MAA w/2% nDDM, 33,360 Mw;
D-65% EA/35% MAA w/2% nDDM, 31,771 Mw;
H-40% EA/50% MAA/10% LMA w/2% nDDM, 103,790 Mw.

Experiment 589

Initial Laundering Conditions: Total water volume of 1 liter. 1.0 grams of 10.5% surfactant added (1.0 gram/Liter), 1.0 grams of 1% active polymer solution added (10 ppm concentration), 20° C. washing conditions, 300 ppm total water hardness (2/1 $Ca^{+2}/Mg^{+2}$), US Testing Tergotometer, 12 minute wash, 3 minute rinse (cold tap water), tumble dry, two 8.9×11.4 cm Cotton, two 8.9×11.4 cm PE/Cotton, two 8.9×11.4 cm Polyester and two 8.9×11.4 cm Cotton Interlock (all from Test Fabrics). 2.5 grams Dust Sebum Emulsion (courtesy Scientific Services) and 2.5 grams of 25% Big Oak Clay Slurry added at the start of each wash. All cloths were stripped by washing 3× in PUREX FREE CLEAR detergent base prior to the experiment.

Whiteness index-WIE313 (avg. of 4 values from Hunter Lab Colorimeter) after 2 cycles total:

| Swatch type | Polymer | Average |
|---|---|---|
| Cotton | No Polymer | 58.4 |
| Cotton | Comp. AA | 67.0 |
| Cotton | E | 66.0 |
| Cotton | F | 72.5 |
| Cotton | G | 76.0 |
| Cotton | A | 75.3 |
| Poly-cotton | No Polymer | 75.3 |
| Poly-cotton | Comp. AA | 76.3 |
| Poly-cotton | E | 75.4 |
| Poly-cotton | F | 78.9 |
| Poly-cotton | G | 79.4 |
| Poly-cotton | A | 78.9 |
| Cotton Interlock | No Polymer | 67.9 |
| Cotton Interlock | Comp. AA | 70.8 |
| Cotton Interlock | E | 73.6 |
| Cotton Interlock | F | 76.1 |
| Cotton Interlock | G | 77.9 |
| Cotton Interlock | A | 77.5 |
| Polyester | No Polymer | 54.9 |
| Polyester | Comp. AA | 64.5 |
| Polyester | E | 58.5 |
| Polyester | F | 67.2 |

-continued

| Swatch type | Polymer | Average |
|---|---|---|
| Polyester | G | 65.7 |
| Polyester | A | 65.2 |

Sample compositions:
E-28.3% EA/28.3% BA/43.3% MAA w/1.25% nDDM, 54,472 Mw;
F-52.2% EA/47.8% MAA w/1.5% nDDM, 51,080 Mw;
G-65% EA/35% MAA w/1.3% nDDM, 56,101 Mw;
A-45% EA/10% MA-23/45% MAA/w/1% nDDM, 65,873 Mw.

Experiment 590B

Whiteness index-WIE313 (avg. of 4 values from Hunter Lab Colorimeter), 10 cycles total: Initial Laundering Conditions: Total water volume of 1 liter. 1.0 grams of 26.0% surfactant added (1.0 gram/Liter), 1.0 grams of 1% active polymer solution added (10 ppm concentration), 20° C. washing conditions, 300 ppm total water hardness (2/1 $Ca^{+2}/Mg^{+2}$), US Testing Tergotometer, 60 minute wash, 3 minute rinse (cold tap water), tumble dry, two 8.9×11.4 cm Cotton, two 8.9×11.4 cm PE/Cotton, two 8.9×11.4 cm Polyester and two 8.9×11.4 cm Cotton Interlock (all from Test Fabrics). 2.5 grams Dust Sebum Emulsion (courtesy Scientific Services) and 2.5 grams of 25% Big Oak Clay Slurry added at the start of each wash. All cloths were stripped by washing 3× in PUREX FREE CLEAR detergent base prior to the experiment.

| Swatch type | Polymer | Average |
|---|---|---|
| Cotton | No Polymer | 66.0 |
| Cotton | Comp. AA | 66.3 |
| Cotton | C | 73.4 |
| Cotton | E | 67.9 |
| Cotton | F | 70.0 |
| Cotton | G | 72.2 |
| Poly-cotton | No Polymer | 68.3 |
| Poly-cotton | Comp. AA | 69.4 |
| Poly-cotton | C | 73.9 |
| Poly-cotton | E | 71.6 |
| Poly-cotton | F | 71.2 |
| Poly-cotton | G | 72.5 |
| Cotton Interlock | No Polymer | 54.6 |
| Cotton Interlock | Comp. AA | 57.4 |
| Cotton Interlock | C | 65.1 |
| Cotton Interlock | E | 61.4 |
| Cotton Interlock | F | 62.8 |
| Cotton Interlock | G | 61.8 |
| Polyester | No Polymer | 64.6 |
| Polyester | Comp. AA | 66.7 |
| Polyester | C | 67.7 |
| Polyester | E | 62.7 |
| Polyester | F | 63.7 |
| Polyester | G | 64.4 |

Sample compositions:
C-52.2% EA/47.8% MAA w/2% nDDM, 33,360 Mw;
E-28.3% EA/28.3% BA/43.3% MAA w/1.25% nDDM, 54,472 Mw;
F-52.2% EA/47.8% MAA w/1.5% nDDM, 51,080 Mw;
G-65% EA/35% MAA w/1.3% nDDM, 56,101 Mw.

Experiment 592

Whiteness index-WIE313 (avg. of 4 values from Hunter Lab Colorimeter) after 8 cycles total:

Initial Laundering Conditions:

Total water volume of 1 liter. 1.0 grams of 26.0% surfactant added (1.0 gram/Liter), 1.0 grams of 1% active polymer solution added (10 ppm concentration), 20° C. washing conditions, 300 ppm total water hardness (2/1 $Ca^{+2}/Mg^{+2}$), US Testing Tergotometer, 60 minute wash, 3 minute rinse (cold tap water), tumble dry, two 8.9×11.4 cm Cotton, two 8.9×11.4 cm PE/Cotton, two 8.9×11.4 cm Polyester and two 8.9×11.4 cm Cotton Interlock (all from Test Fabrics). 2.5 grams Dust Sebum Emulsion (courtesy Scientific Services) and 2.5 grams of 25% Big Oak Clay Slurry added at the start of each wash. All cloths were stripped by washing 3× in PUREX FREE CLEAR detergent base prior to the experiment.

| Swatch type | Polymer | Average |
|---|---|---|
| Cotton | No Polymer | 67.21 |
| Cotton | Comp. AA | 68.47 |
| Cotton | C | 73.96 |
| Cotton | O | 71.15 |
| Cotton | J | 76.08 |
| Cotton | K | 74.06 |
| Poly-cotton | No Polymer | 71.86 |
| Poly-cotton | Comp. AA | 71.53 |
| Poly-cotton | C | 75.24 |
| Poly-cotton | O | 75.27 |
| Poly-cotton | J | 76.62 |
| Poly-cotton | K | 75.53 |
| Cotton Interlock | No Polymer | 58.64 |
| Cotton Interlock | Comp. AA | 62.49 |
| Cotton Interlock | C | 68.78 |
| Cotton Interlock | O | 65.2 |
| Cotton Interlock | J | 66.99 |
| Cotton Interlock | K | 67.04 |
| Polyester | No Polymer | 65.22 |
| Polyester | Comp. AA | 66.28 |
| Polyester | C | 68.21 |
| Polyester | O | 67.79 |
| Polyester | J | 68.03 |
| Polyester | K | 67.84 |

Sample compositions:
C-52.2% EA/47.8% MAA w/2% nDDM, 33,360 Mw;
O-52.2% EA/47.8% MAA w/3.0% nDDM, 24,506 Mw;
J-65% EA/35% MAA w/3.0% nDDM, 22,897 Mw.
K-28.3% EA/28.3% BA/43.3% MAA w/3.0% nDDM, 21,929 Mw.

Experiment 598

Initial Laundering Conditions:

Total water volume of 1 liter. 1.0 grams of 10.5% surfactant added (1.0 gram/Liter), 1.0 grams of 1% active polymer solution added (10 ppm concentration), 20° C. washing conditions, 300 ppm total water hardness (2/1 $Ca^{+2}/Mg^{+2}$), US Testing Tergotometer, 12 minute wash, 3 minute rinse (cold tap water), tumble dry, two 8.9×11.4 cm Cotton, two 8.9×11.4 cm PE/Cotton, two 8.9×11.4 cm Polyester and two 8.9×11.4 cm Cotton Interlock (all from Test Fabrics). 2.5 grams Dust Sebum Emulsion (courtesy Scientific Services) and 2.5 grams of 25% Big Oak Clay Slurry added at the start of each wash. All cloths were stripped by washing 3× in PUREX FREE CLEAR detergent base prior to the experiment.

Whiteness index-WIE313 (avg. of 4 values from Hunter Lab Colorimeter) after 3 cycles total:

| Swatch type | Polymer | Average |
|---|---|---|
| Cotton | No Polymer | 61.6 |
| Cotton | Comp. AA | 70.5 |
| Cotton | C | 76.4 |
| Cotton | D | 79.6 |
| Cotton | Q | 72.3 |
| Cotton | Comp. E | 62.1 |
| Poly-cotton | No Polymer | 76.1 |
| Poly-cotton | Comp. AA | 76.2 |
| Poly-cotton | C | 80.2 |
| Poly-cotton | D | 80.7 |
| Poly-cotton | Q | 76.8 |
| Poly-cotton | Comp. E | 75.1 |
| Cotton Interlock | No Polymer | 70.5 |
| Cotton Interlock | Comp. AA | 74.6 |
| Cotton Interlock | C | 76.2 |
| Cotton Interlock | D | 77.3 |
| Cotton Interlock | Q | 73.9 |

-continued

| Swatch type | Polymer | Average |
|---|---|---|
| Cotton Interlock | Comp. E | 69.5 |
| Polyester | No Polymer | 63.5 |
| Polyester | Comp. AA | 60.5 |
| Polyester | C | 69.9 |
| Polyester | D | 70.3 |
| Polyester | Q | 63.5 |
| Polyester | Comp. E | 59.4 |

C-52.2% EA/47.8% MAA w/2% nDDM, 33,360 Mw;
D-65% EA/35% MAA w/2% nDDM, 31,771 Mw;
Q-26.1% EA/26.1% BA/47.8% MAA w/2% nDDM, 33,422 Mw. Comp.
E-52.2% BA/47.8% MAA w/2% nDDM, 31,852 Mw.

Experiment 599

Whiteness index-WIE313 (avg. of 4 values from Hunter Lab Colorimeter), 10 cycles total: Initial Laundering Conditions: Total water volume of 1 liter. 1.0 grams of 26.0% surfactant added (1.0 gram/Liter), 1.0 grams of 1% active polymer solution added (10 ppm concentration), 20° C. washing conditions, 300 ppm total water hardness (2/1 $Ca^{+2}/Mg^{+2}$), US Testing Tergotometer, 60 minute wash, 3 minute rinse (cold tap water), tumble dry, two 8.9×11.4 cm Cotton, two 8.9×11.4 cm PE/Cotton, two 8.9×11.4 cm Polyester and two 8.9×11.4 cm Cotton Interlock (all from Test Fabrics). 2.5 grams Dust Sebum Emulsion (courtesy Scientific Services) and 2.5 grams of 25% Big Oak Clay Slurry added at the start of each wash. All cloths were stripped by washing 3× in PUREX FREE CLEAR detergent base prior to the experiment.

| Swatch type | Polymer | Average |
|---|---|---|
| Cotton | No Polymer | 65.1 |
| Cotton | Comp. AA | 66.8 |
| Cotton | C | 73.1 |
| Cotton | D | 71.6 |
| Cotton | Q | 71.0 |
| Cotton | Comp. E | 69.1 |
| Poly-cotton | No Polymer | 68.4 |
| Poly-cotton | Comp. AA | 69.6 |
| Poly-cotton | C | 74.7 |
| Poly-cotton | D | 74.9 |
| Poly-cotton | Q | 74.7 |
| Poly-cotton | Comp. E | 72.4 |
| Cotton Interlock | No Polymer | 51.3 |
| Cotton Interlock | Comp. AA | 56.1 |
| Cotton Interlock | C | 64.8 |
| Cotton Interlock | D | 59.4 |
| Cotton Interlock | Q | 61.8 |
| Cotton Interlock | Comp. E | 61.5 |
| Polyester | No Polymer | 62.7 |
| Polyester | Comp. AA | 64.3 |
| Polyester | C | 65.8 |
| Polyester | D | 66.1 |
| Polyester | Q | 63.8 |
| Polyester | Comp. E | 63.9 |

Sample compositions:
C-52.2% EA/47.8% MAA w/2% nDDM, 33,360 Mw;
D-65% EA/35% MAA w/2% nDDM, 31,771 Mw;
Q-26.1% EA/26.1% BA/47.8% MAA w/2% nDDM, 33,422 Mw.
Comp. E-52.2% BA/47.8% MAA w/2% nDDM, 31,852 Mw.

Experiment 604

Whiteness index-WIE313 (avg. of 4 values from Hunter Lab Colorimeter), 10 cycles total:
Initial Laundering Conditions:

Total water volume of 1 liter. 1.0 grams of 26.0% surfactant added (1.0 gram/Liter), 1.0 grams of 1% active polymer solution added (10 ppm concentration), 20° C. washing conditions, 300 ppm total water hardness (2/1 $Ca^{+2}/Mg^{+2}$), US Testing Tergotometer, 60 minute wash, 3 minute rinse (cold tap water), tumble dry, two 8.9×11.4 cm Cotton, two 8.9×11.4 cm PE/Cotton, two 8.9×11.4 cm Polyester and two 8.9×11.4 cm Cotton Interlock (all from Test Fabrics). 2.5 grams Dust Sebum Emulsion (courtesy Scientific Services) and 2.5 grams of 25% Big Oak Clay Slurry added at the start of each wash. All cloths were stripped by washing 3× in PUREX FREE CLEAR detergent base prior to the experiment.

| Swatch type | Polymer | Average |
|---|---|---|
| Cotton | No Polymer | 67.1 |
| Cotton | Comp. AA | 66.4 |
| Cotton | F | 70.6 |
| Cotton | G | 72.3 |
| Cotton | R | 69.7 |
| Cotton | Comp. F | 70.2 |
| Poly-cotton | No Polymer | 66.9 |
| Poly-cotton | Comp. AA | 64.9 |
| Poly-cotton | F | 72.1 |
| Poly-cotton | G | 72.4 |
| Poly-cotton | R | 71.3 |
| Poly-cotton | Comp. F | 70.6 |
| Cotton Interlock | No Polymer | 54.2 |
| Cotton Interlock | Comp. AA | 55.4 |
| Cotton Interlock | F | 64.9 |
| Cotton Interlock | G | 62.1 |
| Cotton Interlock | R | 62.8 |
| Cotton Interlock | Comp. F | 63.0 |
| Polyester | No Polymer | 63.0 |
| Polyester | Comp. AA | 65.6 |
| Polyester | F | 65.5 |
| Polyester | G | 64.8 |
| Polyester | R | 63.1 |
| Polyester | Comp. F | 63.5 |

Sample compositions:
F-52.2% EA/47.8% MAA w/1.5% nDDM, 51,080 Mw;
G-65% EA/35% MAA w/1.3% nDDM, 56,101 Mw;
R-26.1% EA/26.1% BA/47.8% MAA w/1.25% nDDM, 56,281 Mw;
Comp. F-52.2% BA/47.8% MAA w/1.25% nDDM, 53,286 Mw.

35.6% Surfactant Formulation with Rheology Modifier (ACUSOL 820)

Experiment 605

Initial Laundering Conditions:

Total water volume of 1 liter. 1.0 grams of 35.6% surfactant added (1.0 gram/Liter), 1.0 grams of 1% active polymer solution added (10 ppm concentration), 20° C. washing conditions, 300 ppm total water hardness (2/1 $Ca^{+2}/Mg^{+2}$), US Testing Tergotometer, 60 minute wash, 3 minute rinse (cold tap water), tumble dry, two 8.9×11.4 cm Cotton, two 8.9×11.4 cm PE/Cotton, two 8.9×11.4 cm Polyester and two 8.9×11.4 cm Cotton Interlock (all from Test Fabrics). 2.5 grams Dust Sebum Emulsion (courtesy Scientific Services) and 2.5 grams of 25% Big Oak Clay Slurry added at the start of each wash. All cloths were stripped by washing 3× in PUREX FREE CLEAR detergent base prior to the experiment.

Whiteness index-WIE313 (avg. of 4 values from Hunter Lab Colorimeter) after 2 cycles total:

| Swatch type | Polymer | Average |
|---|---|---|
| Cotton | No Polymer | 50.9 |
| Cotton | Comp. AA | 71.1 |
| Cotton | F | 69.6 |
| Cotton | G | 72.0 |
| Cotton | R | 68.8 |
| Cotton | Comp. E | 60.7 |
| Poly-cotton | No Polymer | 59.3 |
| Poly-cotton | Comp. AA | 73.3 |
| Poly-cotton | F | 73.6 |
| Poly-cotton | G | 76.7 |

-continued

| Swatch type | Polymer | Average |
|---|---|---|
| Poly-cotton | R | 72.1 |
| Poly-cotton | Comp. E | 65.8 |
| Cotton Interlock | No Polymer | 57.7 |
| Cotton Interlock | Comp. AA | 72.8 |
| Cotton Interlock | F | 74.4 |
| Cotton Interlock | G | 74.5 |
| Cotton Interlock | R | 72.0 |
| Cotton Interlock | Comp. E | 64.4 |
| Polyester | No Polymer | 50.6 |
| Polyester | Comp. AA | 64.7 |
| Polyester | F | 65.6 |
| Polyester | G | 69.1 |
| Polyester | R | 61.4 |
| Polyester | Comp. E | 56.5 |

F-52.2% EA/47.8% MAA w/1.5% nDDM, 51,080 Mw;
G-65% EA/35% MAA w/1.3% nDDM, 56,101 Mw;
R-26.1% EA/26.1% BA/47.8% MAA w/1.25% nDDM, 56,281 Mw;
Comp. E-52.2% BA/47.8% MAA w/1.25% nDDM, 53,286 Mw.

35.6% Surfactant Formulation with Rheology Modifier (ACUSOL 820)

Experiment 606

Initial Laundering Conditions:

Total water volume of 1 liter. 1.0 grams of 35.6% surfactant added (1.0 gram/Liter), 1.0 grams of 1% active polymer solution added (10 ppm concentration), 20° C. washing conditions, 300 ppm total water hardness (2/1 $Ca^{+2}/Mg^{+2}$), US Testing Tergotometer, 60 minute wash, 3 minute rinse (cold tap water), tumble dry, two 8.9×11.4 cm Cotton, two 8.9×11.4 cm PE/Cotton, two 8.9×11.4 cm Polyester and two 8.9×11.4 cm Cotton Interlock (all from Test Fabrics). 2.5 grams Dust Sebum Emulsion (courtesy Scientific Services) and 2.5 grams of 25% Big Oak Clay Slurry added at the start of each wash. All cloths were stripped by washing 3× in PUREX FREE CLEAR detergent base prior to the experiment.

Whiteness index-WIE313 (avg. of 4 values from Hunter Lab Colorimeter) after 2 cycles total:

| Swatch type | Polymer | Average |
|---|---|---|
| Cotton | No Polymer | 46.1 |
| Cotton | O | 68.8 |
| Cotton | C | 67.8 |
| Cotton | F | 68.2 |
| Cotton | U | 58.4 |
| Cotton | T | 44.4 |
| Poly-cotton | No Polymer | 60.1 |
| Poly-cotton | O | 74.2 |
| Poly-cotton | C | 75.1 |
| Poly-cotton | F | 73.9 |
| Poly-cotton | U | 69.3 |
| Poly-cotton | T | 63.4 |
| Cotton Interlock | No Polymer | 58.4 |
| Cotton Interlock | O | 72.3 |
| Cotton Interlock | C | 71.9 |
| Cotton Interlock | F | 71.2 |
| Cotton Interlock | U | 65.1 |
| Cotton Interlock | T | 58.6 |
| Polyester | No Polymer | 48.5 |
| Polyester | O | 65.1 |
| Polyester | C | 65.3 |
| Polyester | F | 64.8 |
| Polyester | U | 61.5 |
| Polyester | T | 56.8 |

Sample compositions:
O-52.2% EA/47.8% MAA w/3.0% nDDM, 24,506 Mw;
C-52.2% EA/47.8% MAA w/2% nDDM, 33,360 Mw;
F-52.2% EA/47.8% MAA w/1.5% nDDM, 51,080 Mw;
U-52.2% EA/47.8% MAA w/0.5 nDDM, 161,160 Mw;
T-52.2% EA/47.8% MAA w/no nDDM, 1,914,900 Mw.

35.6% Surfactant Formulation with Rheology Modifier (ACUSOL 820)

Experiment 607

Initial Laundering Conditions:

Total water volume of 1 liter. 1.0 grams of 35.6% surfactant added (1.0 gram/Liter), 1.0 grams of 1% active polymer solution added (10 ppm concentration), 20° C. washing conditions, 300 ppm total water hardness (2/1 $Ca^{+2}/Mg^{+2}$), US Testing Tergotometer, 60 minute wash, 3 minute rinse (cold tap water), tumble dry, two 8.9×11.4 cm Cotton, two 8.9×11.4 cm PE/Cotton, two 8.9×11.4 cm Polyester and two 8.9×11.4 cm Cotton Interlock (all from Test Fabrics). 2.5 grams Dust Sebum Emulsion (courtesy Scientific Services) and 2.5 grams of 25% Big Oak Clay Slurry added at the start of each wash. All cloths were stripped by washing 3× in PUREX FREE CLEAR detergent base prior to the experiment. Whiteness index-WIE313 (avg. of 4 values from Hunter Lab Colorimeter) after 2 cycles total:

| Swatch type | Polymer | Average |
|---|---|---|
| Cotton | No Polymer | 53.6 |
| Cotton | J | 76.0 |
| Cotton | D | 72.3 |
| Cotton | G | 72.4 |
| Cotton | P | 68.8 |
| Cotton | L | 31.5 |
| Poly-cotton | No Polymer | 61.6 |
| Poly-cotton | J | 77.3 |
| Poly-cotton | D | 77.2 |
| Poly-cotton | G | 77.8 |
| Poly-cotton | P | 73.3 |
| Poly-cotton | L | 47.8 |
| Cotton Interlock | No Polymer | 59.2 |
| Cotton Interlock | J | 76.2 |
| Cotton Interlock | D | 76.2 |
| Cotton Interlock | G | 75.5 |
| Cotton Interlock | P | 72.3 |
| Cotton Interlock | L | 42.8 |
| Polyester | No Polymer | 49.3 |
| Polyester | J | 70.0 |
| Polyester | D | 69.5 |
| Polyester | G | 69.7 |
| Polyester | P | 65.5 |
| Polyester | L | 36.4 |

Sample compositions:
J-65% EA/35% MAA w/3.0% nDDM, 22,897 Mw;
D-65% EA/35% MAA w/2% nDDM, 31,771 Mw;
G-65% EA/35% MAA w/1.3% nDDM, 56,101 Mw;
P-65% EA/35% MAA w/0.5% nDDM, 226,770 Mw;
L-65% EA/35% MAA w/no nDDM, 2,702,200 Mw 35.6% Surfactant Formulation with Rheology Modifier (ACUSOL 820)

Experiment 608

Initial Laundering Conditions:

Total water volume of 1 liter. 1.0 grams of 35.6% surfactant added (1.0 gram/Liter), 1.0 grams of 1% active polymer solution added (10 ppm concentration), 20° C. washing conditions, 300 ppm total water hardness (2/1 $Ca^{+2}/Mg^{+2}$), US Testing Tergotometer, 60 minute wash, 3 minute rinse (cold tap water), tumble dry, two 8.9×11.4 cm Cotton, two 8.9×11.4 cm PE/Cotton, two 8.9×11.4 cm Polyester and two 8.9×11.4 cm Cotton Interlock (all from Test Fabrics). 2.5 grams Dust Sebum Emulsion (courtesy Scientific Services) and 2.5 grams of 25% Big Oak Clay Slurry added at the start of each wash. All cloths were stripped by washing 3× in PUREX FREE CLEAR detergent base prior to the experiment.

Whiteness index-WIE313 (avg. of 4 values from Hunter Lab Colorimeter) after 2 cycles total:

| Swatch type | Polymer | Average |
|---|---|---|
| Cotton | No Polymer | 69.7 |
| Cotton | Comp. AA | 77.5 |
| Cotton | D | 79.6 |
| Cotton | N | 80.0 |
| Cotton | M | 76.4 |
| Poly-cotton | No Polymer | 53.8 |
| Poly-cotton | Comp. AA | 73.1 |
| Poly-cotton | D | 76.2 |
| Poly-cotton | N | 76.2 |
| Poly-cotton | M | 73.7 |
| Cotton Interlock | No Polymer | 58.9 |
| Cotton Interlock | Comp. AA | 75.9 |
| Cotton Interlock | D | 75.3 |
| Cotton Interlock | N | 76.5 |
| Cotton Interlock | M | 71.7 |
| Polyester | No Polymer | 44.0 |
| Polyester | Comp. AA | 61.7 |
| Polyester | D | 68.5 |
| Polyester | N | 68.4 |
| Polyester | M | 66.9 |

Sample compositions:
D-65% EA/35% MAA w/2% nDDM, 31,771 Mw;
N-65% EA/20% MAA/15% AA w/2% nDDM, 39,995 Mw;
M-45% EA/35% MAA/20% MA w/2% nDDM, 37,808 Mw.

35.6% Surfactant Formulation with Rheology Modifier (ACUSOL 820)

Experiment 609

Initial Laundering Conditions:

Total water volume of 1 liter. 1.0 grams of 35.6% surfactant added (1.0 gram/Liter), variable polymer (0.5 grams, 1.0 grams, and 2.0 grams) of 1% active polymer solution added (5, ppm, 10 ppm, and 20 ppm concentration), 20° C. washing conditions, 300 ppm total water hardness (2/1 $Ca^{+2}/Mg^{+2}$), US Testing Tergotometer, 60 minute wash, 3 minute rinse (cold tap water), tumble dry, two 8.9×11.4 cm Cotton, two 8.9×11.4 cm PE/Cotton, two 8.9×11.4 cm Polyester and two 8.9×11.4 cm Cotton Interlock (all from Test Fabrics). 2.5 grams Dust Sebum Emulsion (courtesy Scientific Services) and 2.5 grams of 25% Big Oak Clay Slurry added at the start of each wash. All cloths were stripped by washing 3× in PUREX FREE CLEAR detergent base prior to the experiment.

Whiteness index-WIE313 (avg. of 4 values from Hunter Lab Colorimeter) after 3 cycles total:

| Swatch type & % Polymer addition | Polymer | Average |
|---|---|---|
| Cotton (0 ppm polymer) | No Polymer | 57.8 |
| Cotton (5 ppm polymer) | Comp. AA | 72.6 |
| Cotton (10 ppm polymer) | Comp. AA | 73.7 |
| Cotton (5 ppm polymer) | D | 74.9 |
| Cotton (10 ppm polymer) | D | 75.8 |
| Cotton (20 ppm polymer) | D | 78.6 |
| Poly-cotton (0 ppm polymer) | No Polymer | 43.8 |
| Poly-cotton (5 ppm polymer) | Comp. AA | 63.6 |
| Poly-cotton (10 ppm polymer) | Comp. AA | 64.3 |
| Poly-cotton (5 ppm polymer) | D | 69.9 |
| Poly-cotton (10 ppm polymer) | D | 72.6 |
| Poly-cotton (20 ppm polymer) | D | 75.6 |
| Cotton Interlock (0 ppm polymer) | No Polymer | 33.3 |
| Cotton Interlock (5 ppm polymer) | Comp. AA | 61.7 |
| Cotton Interlock (10 ppm polymer) | Comp. AA | 65.4 |
| Cotton Interlock (5 ppm polymer) | D | 63.6 |
| Cotton Interlock (10 ppm polymer) | D | 67.8 |
| Cotton Interlock (20 ppm polymer) | D | 71.0 |
| Polyester (0 ppm polymer) | No Polymer | 35.2 |
| Polyester (5 ppm polymer) | Comp. AA | 51.9 |
| Polyester (10 ppm polymer) | Comp. AA | 54.5 |
| Polyester (5 ppm polymer) | D | 63.0 |

-continued

| Swatch type & % Polymer addition | Polymer | Average |
|---|---|---|
| Polyester (10 ppm polymer) | D | 65.4 |
| Polyester (20 ppm polymer) | D | 68.4 |

Sample compositions: D-65% EA/35% MAA w/2% nDDM, 31,771 Mw.

35.6% Surfactant Formulation with Rheology Modifier (ACUSOL 820)

Experiment 610

Initial Laundering Conditions:

Total water volume of 1 liter. 1.0 grams of 35.6% surfactant added (1.0 gram/Liter), variable polymer (0.5 grams, 1.0 grams, and 2.0 grams) of 1% active polymer solution added (5, ppm, 10 ppm, and 20 ppm concentration), 20° C. washing conditions, 300 ppm total water hardness (2/1 $Ca^{+2}/Mg^{+2}$), US Testing Tergotometer, 60 minute wash, 3 minute rinse (cold tap water), tumble dry, two 8.9×11.4 cm Cotton, two 8.9×11.4 cm PE/Cotton, two 8.9×11.4 cm Polyester and two 8.9×11.4 cm Cotton Interlock (all from Test Fabrics). 2.5 grams Dust Sebum Emulsion (courtesy Scientific Services) and 2.5 grams of 25% Big Oak Clay Slurry added at the start of each wash. All cloths were stripped by washing 3× in PUREX FREE CLEAR detergent base prior to the experiment.

Whiteness index-WIE313 (avg. of 4 values from Hunter Lab Colorimeter) after 3 cycles total:

| Swatch type & % Polymer addition | Polymer | Average |
|---|---|---|
| Cotton (0 ppm polymer) | No Polymer | 56.6 |
| Cotton (5 ppm polymer) | Comp. AA | 75.0 |
| Cotton (10 ppm polymer) | Comp. AA | 75.4 |
| Cotton (5 ppm polymer) | C | 75.0 |
| Cotton (10 ppm polymer) | C | 74.7 |
| Cotton (20 ppm polymer) | C | 78.1 |
| Poly-cotton (0 ppm polymer) | No Polymer | 38.6 |
| Poly-cotton (5 ppm polymer) | Comp. AA | 65.0 |
| Poly-cotton (10 ppm polymer) | Comp. AA | 66.8 |
| Poly-cotton (5 ppm polymer) | C | 66.8 |
| Poly-cotton (10 ppm polymer) | C | 70.1 |
| Poly-cotton (20 ppm polymer) | C | 73.5 |
| Cotton Interlock (0 ppm polymer) | No Polymer | 37.8 |
| Cotton Interlock (5 ppm polymer) | Comp. AA | 65.8 |
| Cotton Interlock (10 ppm polymer) | Comp. AA | 69.0 |
| Cotton Interlock (5 ppm polymer) | C | 67.4 |
| Cotton Interlock (10 ppm polymer) | C | 69.6 |
| Cotton Interlock (20 ppm polymer) | C | 75.3 |
| Polyester (0 ppm polymer) | No Polymer | 34.0 |
| Polyester (5 ppm polymer) | Comp. AA | 49.5 |
| Polyester (10 ppm polymer) | Comp. AA | 52.3 |
| Polyester (5 ppm polymer) | C | 56.7 |
| Polyester (10 ppm polymer) | C | 60.6 |
| Polyester (20 ppm polymer) | C | 64.2 |

Sample compositions: C-52.2% EA/47.8% MAA w/2% nDDM, 33,360 Mw.

35.6% Surfactant Formulation with Rheology Modifier (ACUSOL 820)

Experiment 612

Initial Laundering Conditions:

Total water volume of 1 liter. 1.0 grams of 35.6% surfactant added (1.0 gram/Liter), variable polymer (0.5 grams, 1.0 grams, and 2.0 grams) of 1% active polymer solution added (5, ppm, 10 ppm, and 20 ppm concentration), 20° C. washing conditions, 300 ppm total water hardness (2/1 $Ca^{+2}/Mg^{+2}$), US Testing Tergotometer, 60 minute wash, 3 minute rinse (cold tap water), tumble dry, two 8.9×11.4 cm Cotton, two 8.9×11.4 cm PE/Cotton, two 8.9×11.4 cm Polyester and two 8.9×11.4 cm Cotton Interlock (all from Test Fabrics). 2.5 grams Dust Sebum Emulsion (courtesy Scientific Services)

and 2.5 grams of 25% Big Oak Clay Slurry added at the start of each wash. All cloths were stripped by washing 3× in PUREX FREE CLEAR detergent base prior to the experiment.

Whiteness index-WIE313 (avg. of 4 values from Hunter Lab Colorimeter) after 3 cycles total:

| Swatch type & % polymer addition | Polymer | Average |
|---|---|---|
| Cotton (0 ppm polymer) | No Polymer | 54.7 |
| Cotton (5 ppm polymer) | Comp. AA | 71.0 |
| Cotton (10 ppm polymer) | Comp. AA | 72.3 |
| Cotton (5 ppm polymer) | S | 74.0 |
| Cotton (10 ppm polymer) | S | 75.6 |
| Cotton (20 ppm polymer) | S | 78.4 |
| Poly-cotton (0 ppm polymer) | No Polymer | 32.6 |
| Poly-cotton (5 ppm polymer) | Comp. AA | 59.4 |
| Poly-cotton (10 ppm polymer) | Comp. AA | 60.4 |
| Poly-cotton (5 ppm polymer) | S | 65.5 |
| Poly-cotton (10 ppm polymer) | S | 69.9 |
| Poly-cotton (20 ppm polymer) | S | 74.4 |
| Cotton Interlock (0 ppm polymer) | No Polymer | 33.3 |
| Cotton Interlock (5 ppm polymer) | Comp. AA | 60.1 |
| Cotton Interlock (10 ppm polymer) | Comp. AA | 61.3 |
| Cotton Interlock (5 ppm polymer) | S | 61.3 |
| Cotton Interlock (10 ppm polymer) | S | 66.0 |
| Cotton Interlock (20 ppm polymer) | S | 71.0 |
| Polyester (0 ppm polymer) | No Polymer | 20.9 |
| Polyester (5 ppm polymer) | Comp. AA | 42.7 |
| Polyester (10 ppm polymer) | Comp. AA | 46.1 |
| Polyester (5 ppm polymer) | S | 58.7 |
| Polyester (10 ppm polymer) | S | 63.2 |
| Polyester (20 ppm polymer) | S | 66.7 |

S-58.6% EA/41.4% MAA w/2% nDDM, 31,610 Mw.

35.6% Surfactant Formulation with Rheology Modifier (ACUSOL 820)

Experiment 613

Initial Laundering Conditions:

Total water volume of 1 liter. 1.0 grams of 35.6% surfactant added (1.0 gram/Liter), 3.0 grams of 1% active polymer solution added (30 ppm concentration), 20° C. washing conditions, 300 ppm total water hardness (2/1 $Ca^{+2}/Mg^{+2}$), US Testing Tergotometer, 60 minute wash, 3 minute rinse (cold tap water), tumble dry, two 8.9×11.4 cm Cotton, two 8.9×11.4 cm PE/Cotton, two 8.9×11.4 cm Polyester and two 8.9×11.4 cm Cotton Interlock (all from Test Fabrics). 2.5 grams Dust Sebum Emulsion (courtesy Scientific Services) and 2.5 grams of 25% Big Oak Clay Slurry added at the start of each wash. All cloths were stripped by washing 3× in PUREX FREE CLEAR detergent base prior to the experiment.

Whiteness index-WIE313 (avg. of 4 values from Hunter Lab Colorimeter) after 9 cycles total:

| Swatch type | Polymer | Average |
|---|---|---|
| Cotton | No Polymer | 39.7 |
| Cotton | Comp. AA | 68.1 |
| Cotton | C | 71.6 |
| Cotton | D | 75.9 |
| Cotton | N | 76.2 |
| Cotton | S | 75.2 |
| Poly-cotton | No Polymer | 27.0 |
| Poly-cotton | Comp. AA | 57.2 |
| Poly-cotton | C | 66.4 |
| Poly-cotton | D | 73.0 |
| Poly-cotton | N | 73.5 |
| Poly-cotton | S | 71.5 |
| Cotton Interlock | No Polymer | 19.0 |
| Cotton Interlock | Comp. AA | 50.2 |
| Cotton Interlock | C | 62.2 |
| Cotton Interlock | D | 68.6 |
| Cotton Interlock | N | 68.8 |
| Cotton Interlock | S | 66.9 |

-continued

| Swatch type | Polymer | Average |
|---|---|---|
| Polyester | No Polymer | 35.9 |
| Polyester | Comp. AA | 51.2 |
| Polyester | C | 61.1 |
| Polyester | D | 67.2 |
| Polyester | N | 65.4 |
| Polyester | S | 66.9 |

Sample compositions:

C-52.2% EA/47.8% MAA w/2% nDDM, 33,360 Mw; D-65% EA/35% MAA w/2% nDDM, 31,771 Mw; N-65% EA/20% MAA/15% AA w/2% nDDM, 39,995 Mw. S-58.6% EA/41.4% MAA w/2% nDDM, 31,610 Mw

Experiment 614

Formulation Stability experiments for 25.1% Surfactant formulation with 1% and 3% polymer solids. Final formulation equals pH 8.8.

25.1% Surfactant Formulation Used Formulation Stability Tests with 1% Active Polymer

| Ingredients (in order of addition) | % Active | % Active in product |
|---|---|---|
| Deionized Water | | 66.4 |
| Linear alkyl benzene sulfonate (WITCO 90 Flake) | 90.0 | 7.0 |
| Sodium Alcohol Ethoxylate Sulfate (Witcolate LES-60C) | 60.0 | 10.0 |
| Sodium Lauryl Ether Sulfate (Empicol ESB 70) | 70.0 | 5.48 |
| Propylene Glycol | 100.0 | 5.00 |
| Ethanol | 100.0 | 2.5 |
| Alcohol Ethoxylate (NEODOL 25-7) | 100.0 | 2.64 |
| Polymer | Variable | 1.00 |
| 10% NaOH | 10.0 | 0.1 |
| TOTAL (final pH = 8.8) | | 100 |

Formulation pH adjusted to 8.8 with 10% NaOH.

25.1% Surfactant Formulation Used Formulation Stability Tests with 3% Active Polymer

| Ingredients (in order of addition) | % Active | % Active in product |
|---|---|---|
| Deionized Water | | 64.4 |
| Linear alkyl benzene sulfonate (WITCO 90 Flake) | 90.0 | 7.0 |
| Sodium Alcohol Ethoxylate Sulfate (Witcolate LES-60C) | 60.0 | 10.0 |
| Sodium Lauryl Ether Sulfate (Empicol ESB 70) | 70.0 | 5.48 |
| Propylene Glycol | 100.0 | 5.00 |
| Ethanol | 100.0 | 2.5 |
| Alcohol Ethoxylate (NEODOL 25-7) | 100.0 | 2.64 |
| Polymer | Variable | 3.00 |
| 10% NaOH | 10.0 | 0.1 |
| TOTAL (final pH = 8.8) | | 100 |

Formulation pH adjusted to 8.8 with 10% NaOH.

1 Week Formulation Stability Results

| | surf. level/ polymer | % polymer in formula | room temp. | 4° C. | 45° C. oven | Freeze/ Thaw | room temp. turbidity (NTU) |
|---|---|---|---|---|---|---|---|
| 1) | 25.12%/C | 3 | stable | stable | stable | stable | 1.1 |
| 2) | 25.12%/D | 3 | stable | stable | stable | stable | <0.1 |
| 3) | 25.12%/N | 3 | stable | stable | stable | stable | <0.1 |

-continued

| | surf. level/ polymer | % polymer in formula | room temp. | 4° C. | 45° C. oven | Freeze/ Thaw | room temp. turbidity (NTU) |
|---|---|---|---|---|---|---|---|
| 4) | 25.12%/S | 3 | stable | stable | stable | stable | <0.1 |
| 5) | 25.12%/M | 3 | stable | stable | stable | stable | <0.1 |
| 6) | 25.12%/N | 1 | stable | stable | stable | stable | <0.1 |
| 7) | 25.12%/O | 1 | stable | stable | stable | stable | <0.1 |
| 8) | 25.12%/Q | 1 | stable | stable | stable | stable | <0.1 |
| 9) | 25.12%/S | 1 | stable | stable | stable | stable | 0.8 |
| 10) | 25.12%/T | 1 | stable | stable | stable | stable | 0.7 |

4 Week Formulation Stability Results

| | surf. level/ polymer | % polymer in formula | room temp. | 4° C. | 45° C. oven | Freeze/ Thaw | room temp. turbidity (NTU) | 4° C. turbidity (NTU) |
|---|---|---|---|---|---|---|---|---|
| 1) | 25.12%/C | 3 | stable | stable | stable | stable | <0.10 | 0.16 |
| 2) | 25.12%/D | 3 | stable | stable | stable | stable | <0.10 | <0.10 |
| 3) | 25.12%/N | 3 | stable | stable | stable | stable | <0.10 | <0.10 |
| 4) | 25.12%/S | 3 | stable | stable | stable | stable | <0.10 | <0.10 |
| 5) | 25.12%/M | 3 | stable | stable | stable | stable | 0.4 | <0.10 |
| 6) | 25.12%/N | 1 | stable | stable | stable | stable | <0.10 | <0.10 |
| 7) | 25.12%/O | 1 | stable | stable | stable | stable | <0.10 | 0.3 |
| 8) | 25.12%/Q | 1 | stable | stable | stable | stable | 0.1 | <0.10 |
| 9) | 25.12%/S | 1 | stable | stable | stable | stable | 0.4 | <0.10 |
| 10) | 25.12%/T | 1 | stable | stable | stable | stable | <0.10 | <0.10 |

C-52.2% EA/47.8% MAA w/ 2% nDDM, 33,360 Mw;
D-65% EA/35% MAA w/ 2% nDDM, 31,771 Mw;
N-65% EA/20% MAA/15% AA w/ 2% nDDM, 39,995 Mw.
S-58.6% EA/41.4% MAA w/ 2% nDDM, 31,610 Mw;
M-45% EA/35% MAA/20% MA w/ 2% nDDM, 37,808 Mw;
O-52.2% EA/47.8% MAA w/ 3% nDDM, 24,096 Mw.
Q-26.1% EA/26.1% BA/47.8% MAA w/ 2% nDDM, 33,422 Mw.
T-52.2% BA/47.8% MAA w/ 2% nDDM, 31,852 Mw.

Experiment 615

Formulation Stability experiments for 35.5% Surfactant/ Fatty Acid Soap formulation with 1% and 3% polymer solids. Final formulation equals pH 8.8.

Formulation for 35.5% Surfactant Formulation with 1% Active Polymer

| Ingredients (in order of addition) | % Active | % Actives in Formulation |
|---|---|---|
| Deionized Water | | 49.74 |
| Linear Alkyl Benzene Sulfonate (Witco 90 Flake) | 90.0 | 19.51 |
| Alcohol Ethoxylate (NEODOL 25-7) | 100.0 | 11.3 |
| Sodium Citrate $2H_2O$ | 100.0 | 2.1 |
| Propylene Glycol | 100.0 | 5.1 |
| Ethanol | 100.0 | 2.1 |
| Sodium Xylene Sulfonate | 93.0 | 2.6 |
| Polymer | 30.0 | 1.0 |
| PRIFAC 7908 fatty acid soap (palm kernel fatty acid) | 100.0 | 4.7 |
| 0.9% ACUSOL 820 | 29.88 | 0.9 |
| 10% NaOH (pH = 8.75) | 10.00 | 0.95 |
| TOTAL | | 100.00 |

Formulation for 35.5% Surfactant Formulation with 3% Active Polymer

| Ingredients (in order of addition) | % Active | % Actives in Formulation |
|---|---|---|
| Deionized Water | | 47.74 |
| Linear Alkyl Benzene Sulfonate (Witco 90 Flake) | 90.0 | 19.51 |
| Alcohol Ethoxylate (NEODOL 25-7) | 100.0 | 11.3 |
| Sodium Citrate $2H_2O$ | 100.0 | 2.1 |
| Propylene Glycol | 100.0 | 5.1 |
| Ethanol | 100.0 | 2.1 |
| Sodium Xylene Sulfonate | 93.0 | 2.6 |

-continued

| Ingredients (in order of addition) | % Active | % Actives in Formulation |
|---|---|---|
| Polymer | 30.0 | 3.0 |
| PRIFAC 7908 fatty acid soap (palm kernel fatty acid) | 100.0 | 4.7 |
| 0.9% ACUSOL 820 | 29.88 | 0.9 |
| 10% NaOH (pH = 8.75) | 10.00 | 0.95 |
| TOTAL | | 100.00 |

1 Week Formulation Stability Results

| | surf. level/ polymer | % polymer in formula | room temp. | 4° C. | 45° C. oven | Freeze/ Thaw | room temperature turbidity (NTU) |
|---|---|---|---|---|---|---|---|
| 1) | 35.55%/C | 3 | stable | stable | stable | stable | 3.4 |
| 2) | 35.55%/D | 3 | stable | stable | stable | stable | 18.4 |
| 3) | 35.55%/N | 3 | stable | stable | stable | stable | 14.5 |
| 4) | 35.55%/S | 3 | stable | stable | stable | stable | 4.6 |
| 5) | 35.55%/M | 3 | stable | stable | stable | stable | 7.7 |
| 6) | 35.55%/N | 1 | stable | stable | stable | stable | 10.8 |
| 7) | 35.55%/O | 1 | stable | stable | stable | stable | 12.8 |
| 8) | 35.55%/Q | 1 | stable | stable | stable | stable | 15.2 |
| 9) | 35.55%/S | 1 | stable | stable | stable | stable | 9.11 |
| 10) | 35.55%/T | 1 | stable | stable | stable | stable | 22 |

4 Week Formulation Stability Results

| surf. level/ polymer | % polymer in formula | room temp. | 4° C. | 45° C. oven | Freeze/ Thaw | room temp. turbidity (NTU) | 4° C. turbidity (NTU) |
|---|---|---|---|---|---|---|---|
| 1) 35.55%/C | 3 | stable | stable | stable | stable | 2.9 | 4.1 |
| 2) 35.55%/D | 3 | stable | stable | stable | stable | 15.3 | 16.5 |
| 3) 35.55%/N | 3 | stable | stable | stable | stable | 14.7 | 13.7 |
| 4) 35.55%/S | 3 | stable | stable | stable | stable | 10.5 | 9.6 |
| 5) 35.55%/M | 3 | stable | stable | stable | stable | 14.7 | 16.9 |
| 6) 35.55%/N | 1 | stable | stable | stable | stable | 12.5 | 14.4 |
| 7) 35.55%/O | 1 | stable | stable | stable | stable | 13.6 | 10.6 |
| 8) 35.55%/Q | 1 | stable | stable | stable | stable | 15.6 | 12.7 |
| 9) 35.55%/S | 1 | stable | stable | stable | stable | 13.0 | 13.7 |
| 10) 35.55%/T | 1 | stable | stable | stable | stable | 17.6 | 18.7 |

C-52.2% EA/47.8% MAA w/ 2% nDDM, 33,360 Mw;
D-65% EA/35% MAA w/ 2% nDDM, 31,771 Mw;
N-65% EA/20% MAA/15% AA w/ 2% nDDM, 39,995 Mw;
S-58.6% EA/41.4% MAA w/ 2% nDDM, 31,610 Mw;
M-45% EA/35% MAA/20% MA w/ 2% nDDM, 37,808 Mw;
O-52.2% EA/47.8% MAA w/ 3% nDDM, 24,096 Mw;
Q-26.1% EA/26.1% BA/47.8% MAA w/ 2% nDDM, 33,422 Mw.
T-52.2% BA/47.8% MAA w/ 2% nDDM, 31,852 Mw.

Experiment 623

Formulation Stability experiments for 45.03% Surfactant formulation with 4.18% active polymer solids. Final formulation equals pH 8.8.

| Ingredients (in order of addition with mixing) | % Active | % Actives in Formulation |
|---|---|---|
| Deionized Water | | 37.88 |
| Polymer C | 30.0 | 4.18 |
| 50% NaOH | 10.0 | 0.16 |
| Propylene Glycol | 100.0 | 11.95 |
| Ethanol | 100.0 | 0.80 |
| Alcohol Ethoxylate (NEODOL 25-7) | 100.0 | 4.73 |
| Linear Alkyl Benzene Sulfonate (Witco 90 Flake) | 90.0 | 12.55 |
| Sodium Lauryl Ether Sulfate (EMPICOL ESB 70) | 70.0 | 27.75 |
| TOTAL (final formulation pH = 8.91) | | 100.00 |

| Ingredients (in order of addition with mixing) | % Active | % Actives in Formulation |
|---|---|---|
| Deionized Water | | 37.88 |
| Polymer D | 30.0 | 4.18 |
| 50% NaOH | 10.0 | 0.16 |
| Propylene Glycol | 100.0 | 11.95 |
| Ethanol | 100.0 | 0.80 |
| Alcohol Ethoxylate (NEODOL 25-7) | 100.0 | 4.73 |
| Linear Alkyl Benzene Sulfonate (Witco 90 Flake) | 90.0 | 12.55 |
| Sodium Lauryl Ether Sulfate (EMPICOL ESB 70) | 70.0 | 27.75 |
| Dow Corning Defoamer 1520-Antifoam | 20.0 | 30 ppm |
| TOTAL (final formulation pH = 8.7) | | 100.00 |

1 and 3 Week Formulation Stability Results

| surf. level/ polymer | % polymer in formula | room temp. | 4° C. | 45° C. oven | freeze/ thaw | 3 week room temp. turbidity (NTU) | 3 week 4° C. turbidity (NTU) |
|---|---|---|---|---|---|---|---|
| 1) 45.03%/C | 4.18 | stable | stable | stable | stable | <0.10 | <0.10 |
| 2) 45.03%/D | 4.18 | stable | stable | stable | stable | <0.10 | 2.1 |

Experiment 625

35.0% Surfactant Formulation with Rheology Modifier (ACUSOL 820)

Initial Laundering Conditions:

Total water volume of 1 liter. 1.0 grams of 35.0% surfactant added (1.0 gram/Liter), 1 gram polymer of 1% active polymer solution added (10 ppm concentration), 20° C. washing conditions, 300 ppm total water hardness (2/1 $Ca^{+2}/Mg^{+2}$), US Testing Tergotometer, 60 minute wash, 3 minute rinse (cold tap water), tumble dry, two 8.9×11.4 cm Cotton, two 8.9×11.4 cm PE/Cotton, two 8.9×11.4 cm Polyester and two 8.9×11.4 cm Cotton Interlock (all from Test Fabrics). 2.5 grams Dust Sebum Emulsion (courtesy Scientific Services) and 2.5 grams of 25% Big Oak Clay Slurry added at the start of each wash. All cloths were stripped by washing 3× in PUREX FREE CLEAR detergent base prior to the experiment.

Whiteness index-WIE313 (avg. of 4 values from Hunter Lab Colorimeter) after 3 cycles total:

| Swatch Type | Polymer | Whiteness index |
|---|---|---|
| Cotton | No Polymer | 68.3 |
| Cotton | Comp. AA | 79.0 |
| Cotton | D | 81.4 |
| Cotton | V | 79.9 |
| Cotton | W | 80.1 |
| Cotton | X | 79.2 |
| Poly-cotton | No Polymer | 61.6 |
| Poly-cotton | Comp. AA | 72.8 |
| Poly-cotton | D | 77.3 |
| Poly-cotton | V | 72.0 |
| Poly-cotton | W | 77.2 |
| Poly-cotton | X | 71.4 |
| Cotton Interlock | No Polymer | 60.1 |
| Cotton Interlock | Comp. AA | 72.1 |

-continued

| Swatch Type | Polymer | Whiteness index |
|---|---|---|
| Cotton Interlock | D | 76.0 |
| Cotton Interlock | V | 72.0 |
| Cotton Interlock | W | 75.3 |
| Cotton Interlock | X | 72.6 |
| Polyester | No Polymer | 47.2 |
| Polyester | Comp. AA | 59.4 |
| Polyester | D | 68.4 |
| Polyester | V | 62.3 |
| Polyester | W | 67.7 |
| Polyester | X | 57.8 |

Sample compositions:

D-65% EA/35% MAA w/2% nDDM, 31,771 Mw; V-75% EA/25% MAA w/2% nDDM, 37,403 Mw; W-58% EA/15% AA/27% MAA w/2% nDDM, 37,878 Mw. X-40% EA/60% MAA w/2% nDDM, 52,545 Mw.

| Ingredients (in order of addition) | % Active | % Actives in Formulation |
|---|---|---|
| Deionized Water | | 52.22 |
| Witco 90 Flake | 90.0 | 17.24 |
| LES-60C | 60.0 | 0.00 |
| NEODOL 25-7 | 100.0 | 9.99 |
| Sodium Citrate•$2H_2O$ | 100.0 | 1.82 |
| Propylene Glycol | 100.0 | 4.54 |
| Ethanol | 100.0 | 1.82 |
| Sodium Xylene Sulfonate | 93.0 | 2.28 |
| PRIFAC 7908 soap | 100.0 | 7.72 |
| ACUSOL 820 | 29.88 | 0.82 |
| 10% NaOH | 10.00 | 1.55 |
| TOTAL (pH = 8.8) | | 100 |

Experiment 626

35.0% Surfactant Formulation with Rheology Modifier (ACUSOL 820)

Initial Laundering Conditions:

Total water volume of 1 liter. 1.0 grams of 35.0% surfactant added (1.0 gram/Liter), 1 gram polymer of 1% active polymer solution added (10 ppm concentration), 20° C. washing conditions, 300 ppm total water hardness (2/1 $Ca^{+2}/Mg^{+2}$), US Testing Tergotometer, 60 minute wash, 3 minute rinse (cold tap water), tumble dry, two 8.9×11.4 cm Cotton, two 8.9×11.4 cm PE/Cotton, two 8.9×11.4 cm Polyester and two 8.9×11.4 cm Cotton Interlock (all from Test Fabrics). 2.5 grams Dust Sebum Emulsion (courtesy Scientific Services) and 2.5 grams of 25% Big Oak Clay Slurry added at the start of each wash. All cloths were stripped by washing 3× in PUREX FREE CLEAR detergent base prior to the experiment.

Whiteness index-WIE313 (avg. of 4 values from Hunter Lab Colorimeter) after 3 cycles total:

| Swatch Type | Polymer | Whiteness index |
|---|---|---|
| Cotton | No Polymer | 65.7 |
| Cotton | Comp. AA | 75.2 |
| Cotton | D | 75.5 |
| Cotton | Comp. C | 74.1 |
| Cotton | W | 74.2 |
| Cotton | Y | 75.3 |
| Poly-cotton | No Polymer | 51.1 |
| Poly-cotton | Comp. AA | 67.2 |
| Poly-cotton | D | 69.5 |
| Poly-cotton | Comp. C | 66.6 |
| Poly-cotton | W | 69.7 |
| Poly-cotton | Y | 71.1 |
| Cotton Interlock | No Polymer | 50.6 |
| Cotton Interlock | Comp. AA | 67.5 |
| Cotton Interlock | D | 68.6 |

-continued

| Swatch Type | Polymer | Whiteness index |
|---|---|---|
| Cotton Interlock | Comp. C | 67.6 |
| Cotton Interlock | W | 68.6 |
| Cotton Interlock | Y | 71.7 |
| Polyester | No Polymer | 37.8 |
| Polyester | Comp. AA | 57.2 |
| Polyester | D | 63.1 |
| Polyester | Comp. C | 56.3 |
| Polyester | W | 64.0 |
| Polyester | Y | 66.5 |

Sample compositions:

D-65% EA/35% MAA w/2% nDDM, 31,771 Mw; Comp. C-80% AA/20% EA, 25,372 Mw; W-58% EA/15% AA/27% MAA w/2% nDDM, 37,878 Mw. Y-75% EA/25% AA w/2% nDDM, 41,450 Mw

| Ingredients (in order of addition) | % Active | % Actives in Formulation |
|---|---|---|
| Deionized Water | | 52.22 |
| Witco 90 Flake | 90.0 | 17.24 |
| LES-60C | 60.0 | 0.00 |
| NEODOL 25-7 | 100.0 | 9.99 |
| Sodium Citrate $2H_2O$ | 100.0 | 1.82 |
| Propylene Glycol | 100.0 | 4.54 |
| Ethanol | 100.0 | 1.82 |
| Sodium Xylene Sulfonate | 93.0 | 2.28 |
| PRIFAC 7908 soap | 100.0 | 7.72 |
| ACUSOL 820 | 29.88 | 0.82 |
| 10% NaOH | 10.00 | 1.55 |
| TOTAL (pH = 8.8) | | 100 |

The invention claimed is:

1. A liquid laundry detergent composition comprising: (a) from 8 to 50 wt % surfactants; and (b) from 0.05 to 4 wt % of at least one polymer having $M_w$ from 15,000 to 170,000 and comprising polymerized residues of:

(i) 40 to 80 wt % C1-C4 alkyl acrylates; wherein at least 4/10 by weight of the C1-C4 alkyl acrylates is ethyl acrylate; (ii) 20 to 52 wt % C3-C6 carboxylic acid monomers; and (iii) 0 to 10 wt % of monomers having an alkyl group having at least ten carbon atoms; wherein said at least one polymer is not cationically modified.

2. The detergent composition of claim 1 in which the polymer comprises polymerized residues of: (i) 45 to 78 wt % $C_1$-$C_4$ alkyl acrylates; (ii) 22 to 52 wt % (meth)acrylic acid monomers; and (iii) 0 to 8 wt % of polymerized residues of monomers having an alkyl group having at least ten carbon atoms.

3. The detergent composition of claim 2 in which at least 6/10 of the $C_1$-$C_4$ alkyl acrylates is ethyl acrylate.

4. The detergent composition of claim 3 comprising from 0.3 to 3.5 wt % of said polymer.

5. The detergent composition of claim 4 in which the polymer comprises polymerized residues of: (i) 50 to 78 wt % $C_1$-$C_4$ alkyl acrylates; (ii) 22 to 50 wt % (meth)acrylic acid monomers; and (iii) 0 to 6 wt % of polymerized residues of monomers having an alkyl group having at least ten carbon atoms.

6. The detergent composition of claim 5 in which at least 8/10 of the $C_1$-$C_4$ alkyl acrylates is ethyl acrylate.

7. The detergent composition of claim 6 in which the polymer comprises at least 8 wt % polymerized residues of acrylic acid.

8. The detergent composition of claim 7 in which the polymer comprises no more than 3 wt % of polymerized residues of monomers having an alkyl group having at least six carbon atoms.

9. The detergent composition of claim 8 in which the polymer comprises at least 10 wt % polymerized residues of acrylic acid.

10. The detergent composition of claim 2 in which said at least one polymer has $M_w$ from 20,000 to 60,000.

11. The detergent composition of claim 10 in which at least 6/10 of the $C_1$-$C_4$ alkyl acrylates is ethyl acrylate.

12. The detergent composition of claim 11 comprising from 0.3 to 3.5 wt % of said polymer.

* * * * *